US011491811B2

(12) United States Patent
Ikeda

(10) Patent No.: US 11,491,811 B2
(45) Date of Patent: Nov. 8, 2022

(54) PRINTER

(71) Applicant: Seiko Epson Corporation, Tokyo (JP)

(72) Inventor: Hiroyuki Ikeda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/346,342

(22) Filed: Jun. 14, 2021

(65) Prior Publication Data

US 2021/0394541 A1 Dec. 23, 2021

(30) Foreign Application Priority Data

Jun. 18, 2020 (JP) ..... JP2020-105141

(51) Int. Cl.
*B41J 3/36* (2006.01)
*B41J 29/38* (2006.01)

(52) U.S. Cl.
CPC *B41J 29/38* (2013.01); *B41J 3/36* (2013.01)

(58) Field of Classification Search
CPC ..... B41J 3/36
See application file for complete search history.

(56) References Cited

U.S. PATENT DOCUMENTS

2019/0283467 A1 9/2019 Nishii et al.

FOREIGN PATENT DOCUMENTS

JP 01202474 A * 8/1989
JP 2019-155889 9/2019

OTHER PUBLICATIONS

Kamijo et al., MachineTranslation ofJP-01202474-A, 1989 (Year: 1989).*

* cited by examiner

*Primary Examiner* — Scott A Richmond
(74) *Attorney, Agent, or Firm* — Workman Nydegger

(57) ABSTRACT

A printer for performing printing on a medium while being manually moved in a first direction relatively to the medium includes a first roller having frictional contact with the medium while the printer is moved in the first direction to thereby rotate in a first rotational direction, and a first one-way bearing which allows the first roller to rotate in the first rotational direction and restricts the roller's rotating in a second rotational direction opposite to the first rotational direction.

7 Claims, 21 Drawing Sheets

PRINTER

The present application is based on, and claims priority from JP Application Serial Number 2020-105141, filed Jun. 18, 2020, the disclosure of which is hereby incorporated by reference herein in its entirety.

BACKGROUND

1. Technical Field

The present disclosure relates to a printer for performing printing on a medium while being manually moved relatively to the medium.

2. Related Art

In the past, as disclosed in JP-A-2019-155889, there has been known a handy mobile inkjet printer (hereinafter referred to as a "handy printer") which performs printing on a medium while being manually moved relatively to the medium. This handy printer can be moved in a first direction and a second direction opposite to the first direction relatively to the medium.

In a case in which it is necessary for the user to move the handy printer in the first direction in order to make the handy printer perform printing, when the user mistakenly move the handy printer in the second direction, it is unachievable for the handy printer to appropriately print the print image.

SUMMARY

A printer according to the present disclosure is a printer performing printing on a medium while being manually moved in a first direction relatively to the medium and including a roller having frictional contact with the medium while the printer is moved in the first direction to thereby rotate in a first rotational direction, and a first rotation restriction section which allows the roller to rotate in the first rotational direction and restricts the roller's rotating in a second rotational direction opposite to the first rotational direction.

DESCRIPTION OF EXEMPLARY EMBODIMENTS

A printer 101A as a first embodiment of the printer, a printer 101B as a second embodiment, and a printer 101C as a third embodiment will hereinafter be described with reference to the accompanying drawings. It should be noted that when there is no need to distinguish the printer 101A according to the first embodiment, the printer 101B according to the second embodiment, and the printer 101C according to the third embodiment from each other, a simple description of "printer 101" is used. Further, the description will hereinafter be presented using directions defined by an XYZ Cartesian coordinate system shown in each of the drawings, but these directions are for the sake of convenience of explanation only, and do not at all limit the following embodiments.

Printing System

Figure 1:
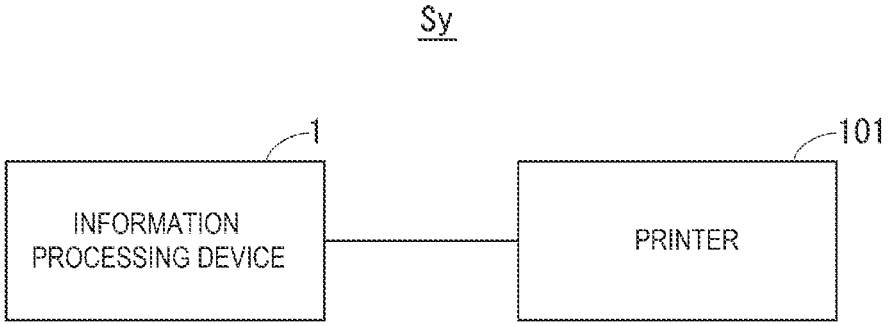
FIG. 1 is a block diagram showing a printing system.

As shown in FIG. 1, the printing system Sy is provided with an information processing device 1, and the printer 101. The information processing device 1 and the printer 101 are coupled to each other so as to be able to communicate with each other wirelessly or with wire.

The information processing device 1 transmits a print job to the printer 101. It should be noted that it is possible to use, for example, a smartphone, a tablet terminal, or a personal computer as the information processing device 1.

Figure 2:
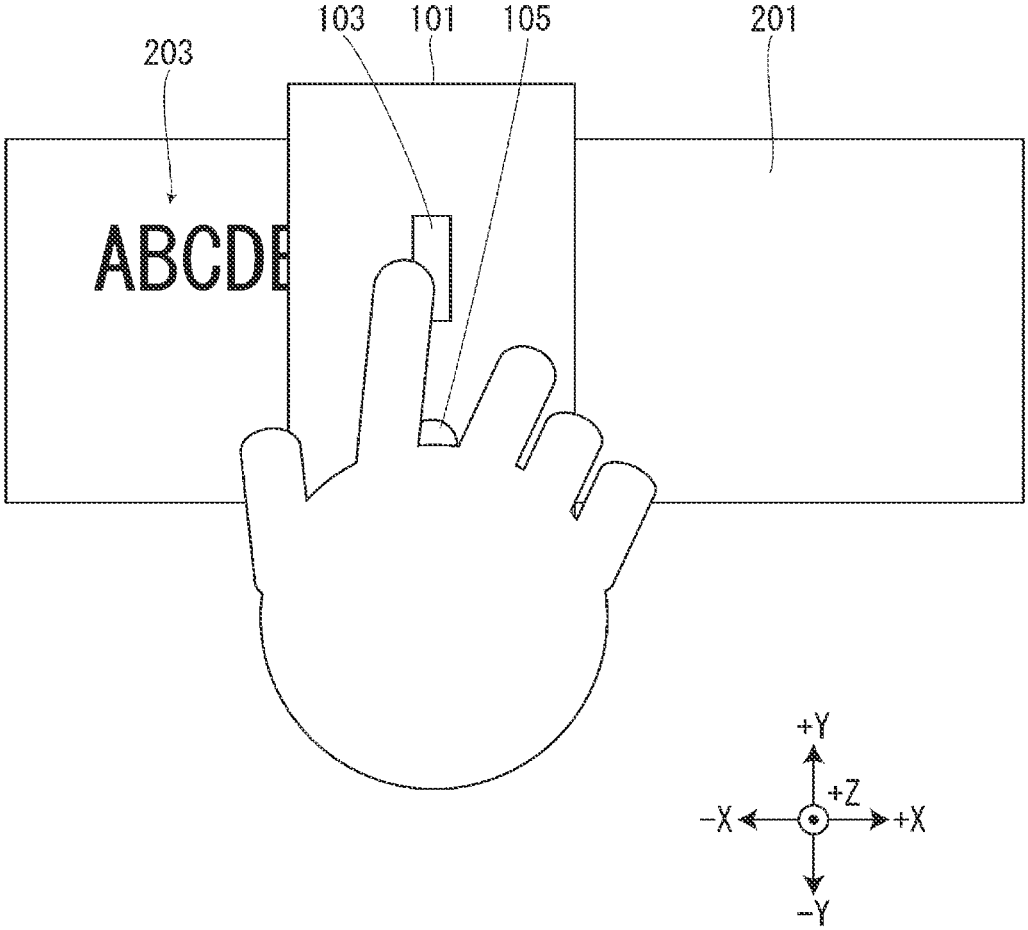
FIG. 2 is a diagram showing a printed object obtained by a printer printing a print image on a medium.

As shown in FIG. 2, the printer 101 is a so-called a handy printer, and is manually moved to a medium 201 to print a print image 203 on the medium 201 based on the print job received from the information processing device 1. The printer 101 ejects ink using an inkjet system to the medium 201 while being manually moved to the medium 201 to thereby print the print image 203 on the medium 201. It should be noted that the medium 201 is not limited to printing paper, but there can be used, for example, an envelope, a postcard, a business card, cardboard, a notebook, a CD (Compact Disc), and a wooden board.

Hardware Configuration of Information Processing Device

Figure 3:
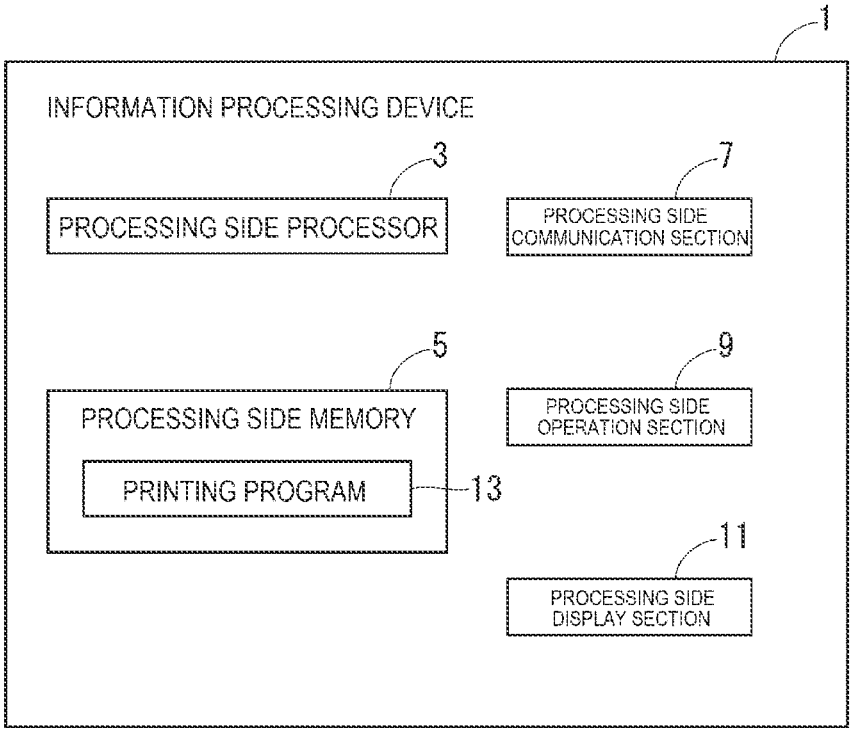
FIG. 3 is a block diagram showing a hardware configuration of an information processing device.

As shown in FIG. 3, the information processing device 1 is provided with a processing side processor 3, a processing side memory 5, a processing side communication section 7, a processing side operation section 9, and a processing side display section 11.

The processing side processor 3 executes a variety of programs stored in the processing side memory 5. The processing side processor 3 is, for example, a single CPU (Central Processing Unit) or a plurality of CPUs. The processing side processor 3 can be a hardware circuit such as an ASIC (Application Specific Integrated Circuit), or can also be a configuration in which one or more CPUs and the hardware circuit such as the ASIC perform processing in cooperation with each other.

The processing side memory 5 stores a variety of programs and a variety of types of data. The processing side memory 5 is provided with, for example, a ROM (Read Only Memory), a RAM (Random Access Memory), and an EEPROM (Electrically Erasable Programmable Read Only Memory). Further, it is possible for the processing side memory 5 to be provided with an HDD (Hard Disk Drive), an SSD (Solid State Drive), or the like.

The variety of programs stored in the processing side memory 5 include a printing program 13. The printing program 13 is an application program corresponding to the printer 101. The processing side processor 3 executes the printing program 13 to thereby generate the print job, and then transmits the print job thus generated to the printer 101.

The processing side communication section 7 transmits/receives a variety of types of data and a variety of commands to/from the printer 101. The processing side communication section 7 is provided with a communication circuit for communicating with the printer 101 with wire or wirelessly.

The processing side operation section 9 receives an operation from the user. As the processing side operation section 9, there can be used, for example, a keyboard and a mouse.

The processing side display section 11 displays a variety of screens. As the processing side display section 11, there can be used, for example, a liquid crystal display or an organic EL (Electro-Luminescence) display. It should be noted that it is possible for the information processing device 1 to have a configuration provided with a touch panel which functions as the processing side operation section 9 and the processing side display section 11.

Basic Configuration of Printer

A basic configuration of the printer 101 will be described. The basic configuration is commonly provided to the printer 101A according to the first embodiment, the printer 101B according to the second embodiment, and the printer 101C according to the third embodiment.

Figure 4:
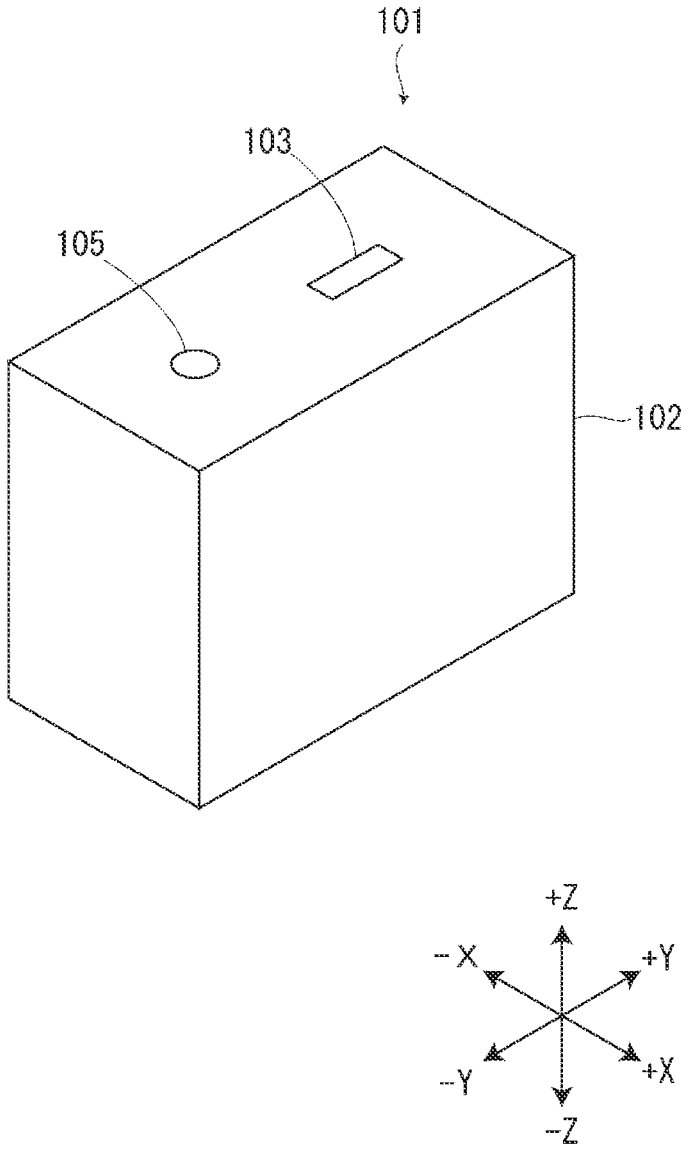
FIG. 4 is a perspective view of a printer.

As shown in FIG. 4, the printer 101 is provided with a chassis 102 formed to have a substantially rectangular solid shape. On the surface at the +Z direction side of the chassis 102, there are disposed a print button 103 and a power button 105. The print button 103 receives an instruction of print start from the user. It is possible for the user to make the printer 101 print the print image 203 by putting the printer 101 on the medium 201, and pushing the print button 103, and then moving the printer 101 gripped by the user along a surface of the medium 201 (see FIG. 2). The power button 105 receives a switching instruction between ON and OFF of the power from the user.

Figure 5:
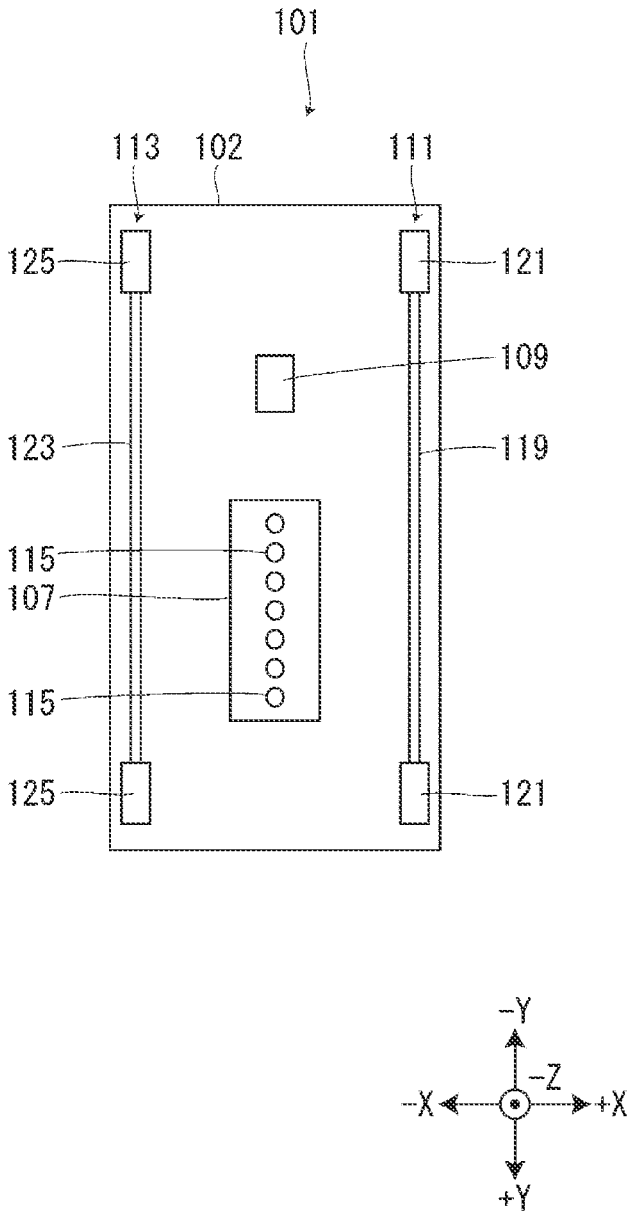
FIG. 5 is a view of the printer viewed from a −Z direction.

As shown in FIG. 5, on a surface at the −Z direction side of the chassis 102, there are disposed a print head 107, a movement detection section 109, a first roller unit 111, and a second roller unit 113.

The print head 107 is an inkjet head provided with a plurality of nozzles 115, and ejects the ink supplied from an ink cartridge (not shown) from the plurality of nozzles 115 to thereby print the print image 203 on the medium 201. The plurality of nozzles 115 is arranged in the Y direction. It should be noted that the print head 107 can be provided with a configuration of being fixed to the printer 101, or can also be provided with a configuration of being integrated with the ink cartridge and detachably attached to the printer 101.

The movement detection section 109 optically detects the movement of the printer 101 which is moved on the medium 210 by the user. It should be noted that detecting the movement of the printer 101 means detecting a movement direction and a movement distance of the printer 101. As the movement detection section 109, there can be used, for example, a device provided with a light source such as an LED (Light Emitting Diode) and an image sensor.

The first roller unit 111 is disposed in an end portion in the +X direction of the surface at the −Z direction side of the chassis 102, and the second roller unit 113 is disposed in an end portion in the −X direction of the surface at the −Z direction side of the chassis 102.

The first roller unit 111 is provided with a first roller shaft 119 and two first rollers 121. The first roller shaft 119 extends in the Y direction, and is rotatably disposed on a bearing not shown. The two first rollers 121 are fixed to both end portions of the first roller shaft 119.

The second roller unit 113 is provided with a second roller shaft 123 and two second rollers 125. The second roller shaft 123 extends in the Y direction, and is rotatably disposed on a bearing not shown. The two second rollers 125 are fixed to both end portions of the second roller shaft 123.

The first rollers 121 and the second rollers 125 have frictional contact with the medium 201 and rotate to thereby guide the movement of the printer 101 to the medium 201. For example, the first rollers 121 and the second rollers 125 rotate clockwise viewed from the −Y direction when the printer 101 is moved in the +X direction. It should be noted that in the following description, "clockwise" means a clockwise direction viewed from the −Y direction, and "counterclockwise" means a counterclockwise direction viewed from the −Y direction without being specifically noted.

When the printer 101 is moved to the medium 201 by the user, the printer 101 calculates a relative position between the printer 101 and the medium 201 based on a detection result of the movement detection section 109, and ejects the ink from the plurality of nozzles 115 at a timing corresponding to the relative position thus calculated. Thus, it is possible for the printer 101 to appropriately print an image on the medium 201 regardless of the speed at which the user moves the printer 101.

Figure 6:
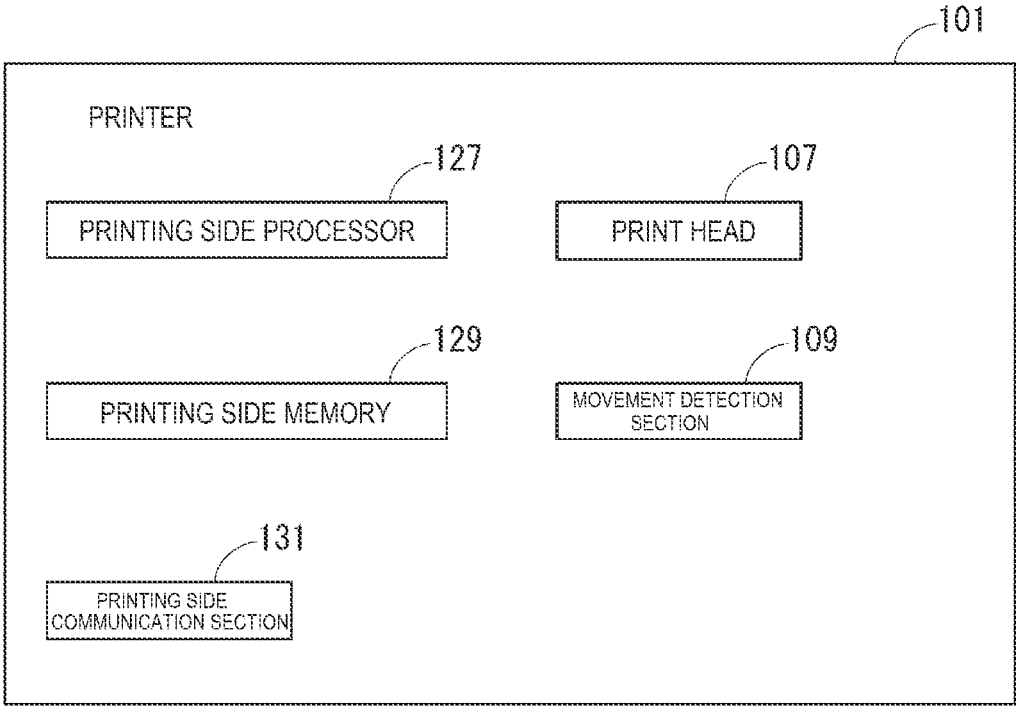
FIG. 6 is a block diagram showing a hardware configuration of a printer.

As shown in FIG. 6, the printer 101 is provided with a printing side processor 127, a printing side memory 129, a printing side communication section 131, the print head 107, and the movement detection section 109.

The printing side processor 127 executes a variety of programs stored in the printing side memory 129. The printing side processor 127 is, for example, a single CPU or a plurality of CPUs. The printing side processor 127 can be a hardware circuit such as an ASIC, or can also be a configuration in which one or more CPUs and the hardware circuit such as the ASIC perform processing in cooperation with each other.

The printing side memory 129 stores a variety of programs and a variety of types of data. The printing side memory 129 is provided with, for example, a ROM and a RAM. Further, the printing side memory 129 can be provided with an EEPROM, an HDD, an SSD, and so on.

The printing side communication section 131 receives a variety of types of data and a variety of commands from the information processing device 1. The printing side communication section 131 is provided with a communication circuit for communicating with the information processing device 1 with wire or wirelessly.

Printer According to First Embodiment

The printer 101A according to the first embodiment is moved to the medium 201 in the +X direction to thereby print the print image 203 on the medium 201. In other words, the direction in which the user should move the printer 101A in order for the printer 101A to perform printing is only the +X direction. Therefore, the print data included in the print job which the printer 101A receives from the information processing device 1 is for making the printer 101A appropriately print the print image 203 when the printer 101A is moved to the medium 201 in the +X direction. Therefore, as described below, the printer 101A is allowed to be moved in the +X direction, and its being moved in the −X direction is restricted.

A first one-way bearing 133 is provided with a first support shaft 135, a first inner race member 137, and a first outer race member 139. The first support shaft 135 extends in the Y direction, and is provided to a frame not shown so as not to be able to rotate. The first inner race member 137 is fitted outside the first support shaft 135, and is supported by the first support shaft 135 so as not to be able to rotate. The first outer race member 139 is fitted outside the first inner race member 137. An outer circumferential surface of the first outer race member 139 has contact with an outer circumferential surface of the first roller 121.

When counterclockwise torque is transmitted to the first outer race member 139, the first outer race member 139 makes an idle rotation in a counterclockwise direction with respect to the first inner race member 137 without engaging with the first inner race member 137. In other words, the first one-way bearing 133 allows the first roller 121 having contact with the first outer race member 139 to rotate clockwise due to the idle rotation in the counterclockwise direction of the first outer race member 139 with respect to the first inner race member 137. Thus, the first one-way bearing 133 allows the printer 101A to be moved by the user in the +X direction. Therefore, when the user attempts to move the printer 101A in the +X direction, the first rollers 121 rotate clockwise, and thus, it is possible to move the printer 101A in the +X direction.

In contrast, when clockwise torque is transmitted, the first outer race member 139 engages with the first inner race member 137 to thereby restrict the clockwise rotation. In other words, since the clockwise rotation of the first outer race member 139 is restricted, the first one-way bearing 133 restricts the counterclockwise rotation of the first roller 121 having contact with the first outer race member 139. Thus, the first one-way bearing 133 restricts the printer 101A's being moved by the user in the −X direction. Therefore, even when the user attempts to move the printer 101A in the −X direction, since the first roller 121 does not rotate counterclockwise, it is unachievable to move the printer 101A in the −X direction.

Figure 7:
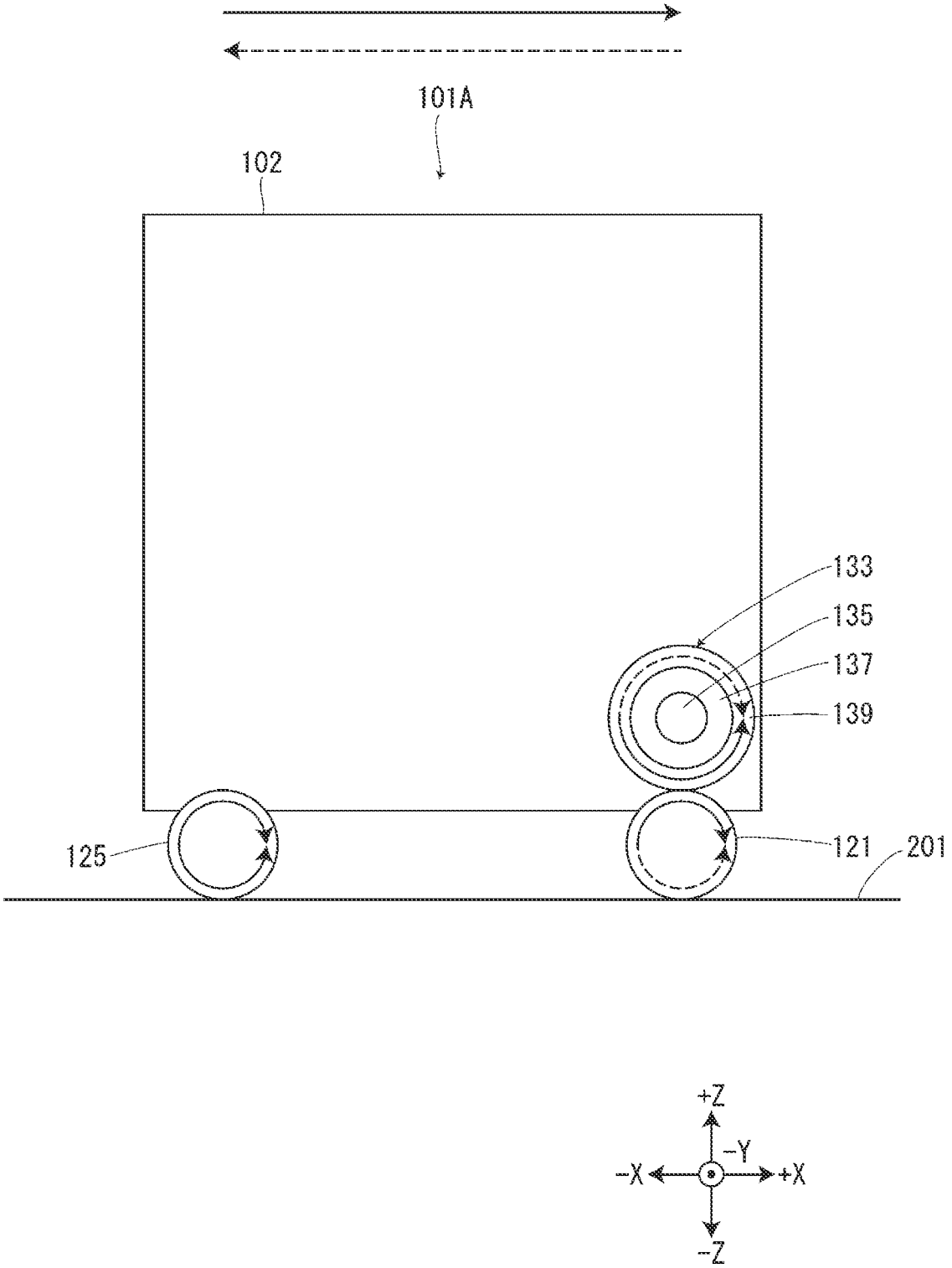
FIG. 7 is a diagram showing a printer according to a first embodiment.

It should be noted that in FIG. 7 and so on, the rotational direction of the idle rotation of the first outer race member 139 with respect to the first inner race member 137 is represented by an arrow with a solid line, and the rotational direction in which the rotation of the first outer race member 139 is restricted is represented by an arrow with a dotted line. Further, the rotational direction of the first roller 121 allowed by the first one-way bearing 133 is represented by an arrow with a solid line, and the rotational direction of the first roller 121 restricted by the first one-way bearing 133 is represented by an arrow with a dotted line. Further, the direction in which the printer 101A is allowed to move is represented by an arrow with a solid line, and the direction in which the printer 101A's moving is restricted is represented by an arrow with a dotted line.

As described hereinabove, according to the printer 101A in the first embodiment, the first roller 121 is allowed to rotate clockwise, and its rotating counterclockwise is restricted by the first one-way bearing 133. Therefore, the printer 101A is allowed to be moved in the +X direction, and its being moved in the −X direction is restricted. Therefore, it is possible to prevent the user from mistakenly moving the printer 101A in the −X direction when the user should move the printer 101A in the +X direction in order for the printer 101A to perform printing.

It should be noted that the printer 101A is not limited to the configuration provided with a signal first one-way bearing 133, but it is possible to adopt a configuration provided with two first one-way bearings 133, or it is also possible to adopt a configuration provided with three or more first one-way bearings 133. In other words, it is possible for the printer 101A to have a configuration provided with both the first one-way bearing 133 having contact with the first roller 121 at the +Y direction side and the first one-way bearing 133 having contact with the first roller 121 at the −Y direction side. When the printer 101A is provided with three or more first rollers 121, it is possible for the printer 101A to have the configuration provided with the three or more first one-way bearings 133 corresponding respectively to the first rollers 121. Further, it is possible for the printer 101A to have a configuration provided with the first one-way bearing 133 having contact with the second roller 125 instead of the first one-way bearing 133 having contact with the first roller 121. It is possible for the printer 101A to have a configuration provided with the first one-way bearing 133 having contact with the second roller 125 in addition to the first one-way bearing 133 having contact with the first roller 121.

Printer According to Second Embodiment

The printer 101B according to the second embodiment is different from the printer 101A according to the first embodiment in the point that it is possible to perform printing not only while being moved in the +X direction but also while being moved in the −X direction. It should be noted that the description of substantially the same configuration of the printer 101B according to the second embodiment as the configuration of the printer 101A according to the first embodiment will hereinafter be omitted.

Figure 8:
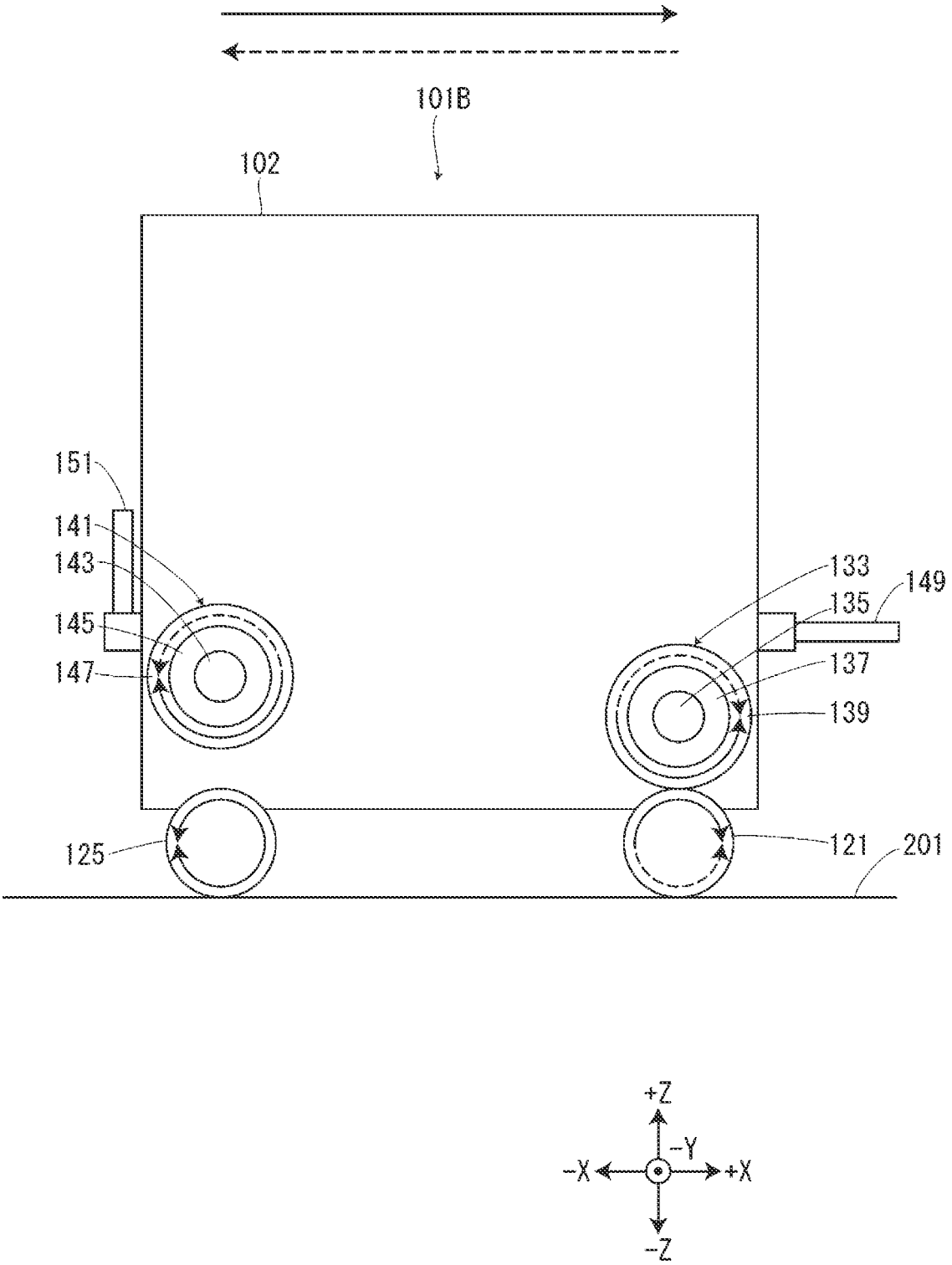
FIG. 8 is a diagram showing a first movement restriction state of a printer according to a second embodiment.
Figure 9:
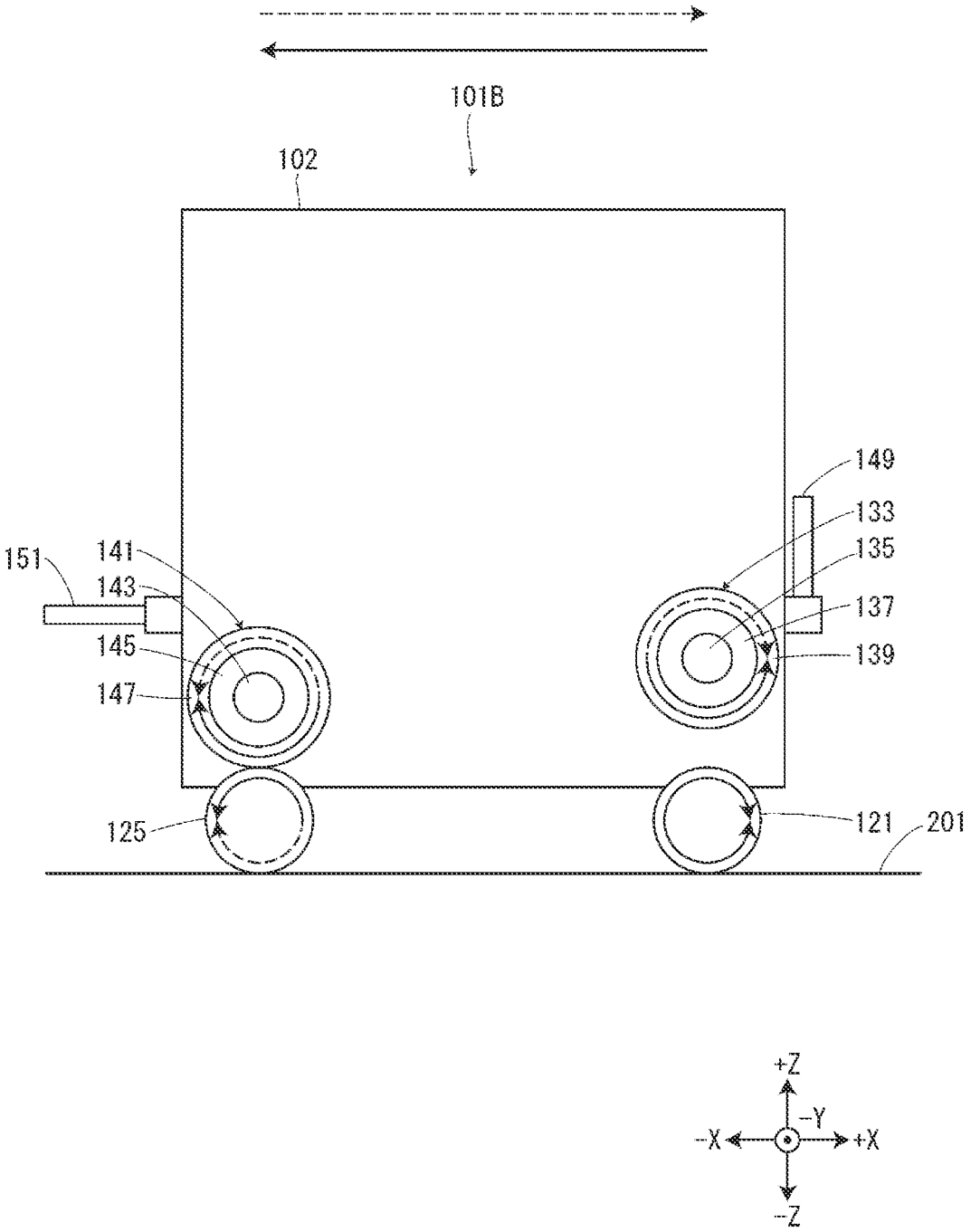
FIG. 9 is a diagram showing a second movement restriction state of the printer according to the second embodiment.

As shown in FIG. 8 and FIG. 9, the printer 101B according to the second embodiment is provided with a second one-way bearing 141 in addition to the first one-way bearing 133. The first one-way bearing 133 is configured similarly to the first embodiment, but the first support shaft 135 is provided to a first lever 149.

The second one-way bearing 141 is provided with a second support shaft 143, a second inner race member 145, and a second outer race member 147. The second support shaft 143 extends in the Y direction, and is provided to the second lever 151 so as not to be able to rotate. The second inner race member 145 is fitted outside the second support shaft 143, and is supported by the second support shaft 143 so as not to be able to rotate. The second outer race member 147 is fitted outside the second inner race member 145. An outer circumferential surface of the second outer race member 147 has contact with an outer circumferential surface of the second roller 125 in the state in which the second one-way bearing 141 is displaced to a second restriction position described later.

When clockwise torque is transmitted to the second outer race member 147, the second outer race member 147 makes an idle rotation in a clockwise direction with respect to the second inner race member 145 without engaging with the second inner race member 145. In other words, the second one-way bearing 141 allows the second roller 125 having contact with the second outer race member 147 to rotate counterclockwise due to the idle rotation in the clockwise direction of the second outer race member 147 with respect to the second inner race member 145. Thus, the second one-way bearing 141 allows the printer 101B to be moved by the user in the −X direction.

In contrast, when counterclockwise torque is transmitted, the second outer race member 147 engages with the second inner race member 145 to thereby restrict the counterclockwise rotation. In other words, since the counterclockwise rotation of the second outer race member 147 is restricted, the second one-way bearing 141 restricts the clockwise rotation of the second roller 125 having contact with the second outer race member 147. Thus, the second one-way bearing 141 restricts the printer 101B's being moved by the user in the +X direction.

Further, the printer 101B is provided with the first lever 149 and the second layer 151. The first lever 149 can rotate between a first contact position (see FIG. 8) and a first noncontact position (see FIG. 9). When the first lever 149 rotates to the first contact position, the first one-way bearing 133 is displaced to a first restriction position in accordance with the rotation. The first restriction position means a position where the first one-way bearing 133 has contact with the first roller 121, namely a position where the first one-way bearing 133 allows the first roller 121 to rotate clockwise and restricts the first roller 121's rotating counterclockwise. On the other hand, when the first lever 149 rotates to the first noncontact position, the first one-way bearing 133 is displaced to a first allowance position in accordance with the rotation. The first allowance position means a position where the first one-way bearing 133 is separated from the first roller 121, namely a position where the first one-way bearing 133 allows the first roller 121 to rotate clockwise and allows the first roller 121 to rotate counterclockwise. It is possible for the user to displace the first one-way bearing 133 to the first restriction position by operating the first lever 149 to the first contact position. Further, it is possible for the user to displace the first one-way bearing 133 to the first allowance position by operating the first lever 149 to the first noncontact position.

The second lever 151 can rotate between a second contact position (see FIG. 9) and a second noncontact position (see FIG. 8). When the second lever 151 rotates to the second contact position, the second one-way bearing 141 is displaced to the second restriction position in accordance with the rotation. The second restriction position means a position where the second one-way bearing 141 has contact with the second roller 125, namely a position where the second one-way bearing 141 restricts the second roller 125's rotating clockwise and allows the second roller 125 to rotate counterclockwise. On the other hand, when the second lever 151 rotates to the second noncontact position, the second one-way bearing 141 is displaced to a second allowance position in accordance with the rotation. The second allowance position means a position where the second one-way bearing 141 is separated from the second roller 125, namely a position where the second one-way bearing 141 allows the second roller 125 to rotate clockwise and allows the second roller 125 to rotate counterclockwise. It is possible for the user to displace the second one-way bearing 141 to the second restriction position by operating the second lever 151 to the second contact position. Further, it is possible for the user to displace the second one-way bearing 141 to the second allowance position by operating the second lever 151 to the second noncontact position.

Incidentally, it is possible for the user to select either one of the +X direction and the −X direction as the direction in which the printer 101B is moved in order for the printer 101B to perform printing in the information processing device 1. When the +X direction is selected by the user, the information processing device 1 generates the print data with which the print image 203 is appropriately printed when the printer 101B is moved in the +X direction, and then transmits the print job including the print data thus generated to the printer 101B. On the other hand, when the −X direction is selected by the user, the information processing device 1 generates the print data with which the print image 203 is appropriately printed when the printer 101B is moved in the −X direction, and then transmits the print job including the print data thus generated to the printer 101B.

Further, when the user selects the +X direction as the direction in which the printer 101B is moved in order for the printer 101B to perform printing in the information processing device 1, the user rotates the first lever 149 to the first contact position and rotates the second lever 151 to the second noncontact position as shown in FIG. 8. Thus, the first one-way bearing 133 is displaced to the first restriction position, and the second one-way bearing 141 is displaced to the second allowance position. Therefore, the first roller 121 is allowed to rotate clockwise, and its rotating counterclockwise is restricted. The second roller 125 is allowed to rotate clockwise, and is allowed to rotate counterclockwise. Therefore, the printer 101B is set to a first movement restriction state, namely a state where being moved in the +X direction is allowed, and being moved in the −X direction is restricted. Therefore, it is possible to prevent the user from mistakenly moving the printer 101B in the −X direction.

On the other hand, when the user selects the −X direction as the direction in which the printer 101B is moved in order for the printer 101B to perform printing in the information processing device 1, the user rotates the first lever 149 to the first noncontact position and rotates the second lever 151 to the second contact position as shown in FIG. 9. Thus, the first one-way bearing 133 is displaced to the first allowance position, and the second one-way bearing 141 is displaced to the second restriction position. Therefore, the first roller 121 is allowed to rotate clockwise, and is allowed to rotate counterclockwise. The second roller 125 is restricted rotating clockwise, and is allowed to rotate counterclockwise. Therefore, the printer 101B is set to a second movement restriction state, namely a state where being moved in the +X direction is restricted, and being moved in the −X direction is allowed. Therefore, it is possible to prevent the user from mistakenly moving the printer 101B in the +X direction.

As described hereinabove, according to the printer 101B related to the second embodiment, when the first one-way bearing 133 is displaced to the first restriction position and the second one-way bearing 141 is displaced to the second allowance position, the first roller 121 is allowed to rotate clockwise, and its rotating counterclockwise is restricted. Thus, the printer 101B becomes in the first movement restriction state. Therefore, it is possible to prevent the user from mistakenly moving the printer 101B in the −X direction when the user should move the printer 101B in the +X direction in order for the printer 101B to perform printing. On the other hand, when the first one-way bearing 133 is displaced to the first allowance position and the second one-way bearing 141 is displaced to the second restriction position, the second roller 125's rotating clockwise is restricted, and its rotating counterclockwise is allowed. Thus, the printer 101B becomes in the second movement restriction state. Therefore, it is possible to prevent the user from mistakenly moving the printer 101B in the +X direction when the user should move the printer 101B in the −X direction in order for the printer 101B to perform printing.

Similarly to the printer 101A according to the first embodiment, the printer 101B according to the second embodiment is not limited to the configuration provided with a single first one-way bearing 133, but it is possible to adopt a configuration provided with two first one-way bearings 133, or it is possible to adopt a configuration provided with three or more first one-way bearings 133. The same applies to the second one-way bearing 141.

The printer 101B is not limited to the configuration in which the first one-way bearings 133 are disposed so as to correspond respectively to the first rollers 121 and the second one-way bearings 141 are disposed so as to correspond respectively to the second rollers 125, but can be provided with a configuration in which both of the first one-way bearing 133 and the second one-way bearing 141 are disposed so as to correspond respectively to the first rollers 121. In other words, it is possible for the printer 101B to have the configuration in which the first one-way bearing 133 is disposed so as to correspond to one of the first rollers 121, and the second one-way bearing 141 is disposed so as to correspond to the other of the first rollers 121. Alternatively, the printer 101B can be provided with a configuration in which the first one-way bearing 133 and the second one-way bearing 141 are disposed so as to correspond to the common first roller 121. Similarly, the printer 101B can be provided with a configuration in which the first one-way bearing 133 and the second one-way bearing 141 are both disposed so as to correspond to the second roller 125.

The printer 101B is not limited to the configuration in which the first one-way bearing 133 is displaced by the first lever 149 and the second one-way bearing 141 is displaced by the second lever 151, and can be provided with a configuration in which the first one-way bearing 133 and the second one-way bearing 141 are displaced by a single lever. Further, the printer 101B is not limited to the configuration in which the displacement of the first one-way bearing 133 or the second one-way bearing 141 is performed manually by the lever operation, and can be provided with a configuration in which the displacement is performed by a drive source such as a motor based on an operation of a button or the like.

Printer According to Third Embodiment

The printer 101C according to the third embodiment is the same as the printer 101B according to the second embodiment in the point that the printer 101 can be set in the first movement restriction state and the second movement restriction state. On the other hand, the printer 101C according to the third embodiment is different from the printer 101B according to the second embodiment in the point that the switching between the first movement restriction state and the second movement restriction state is not performed by the operations of the first lever 149 and the second lever 151, but is automatically performed in accordance with a designation direction designated by the print job received from the information processing device 1. It should be noted that the description of substantially the same configuration of the printer 101C according to the third embodiment as the configuration of the printer 101B according to the second embodiment will hereinafter be omitted.

Figure 10:
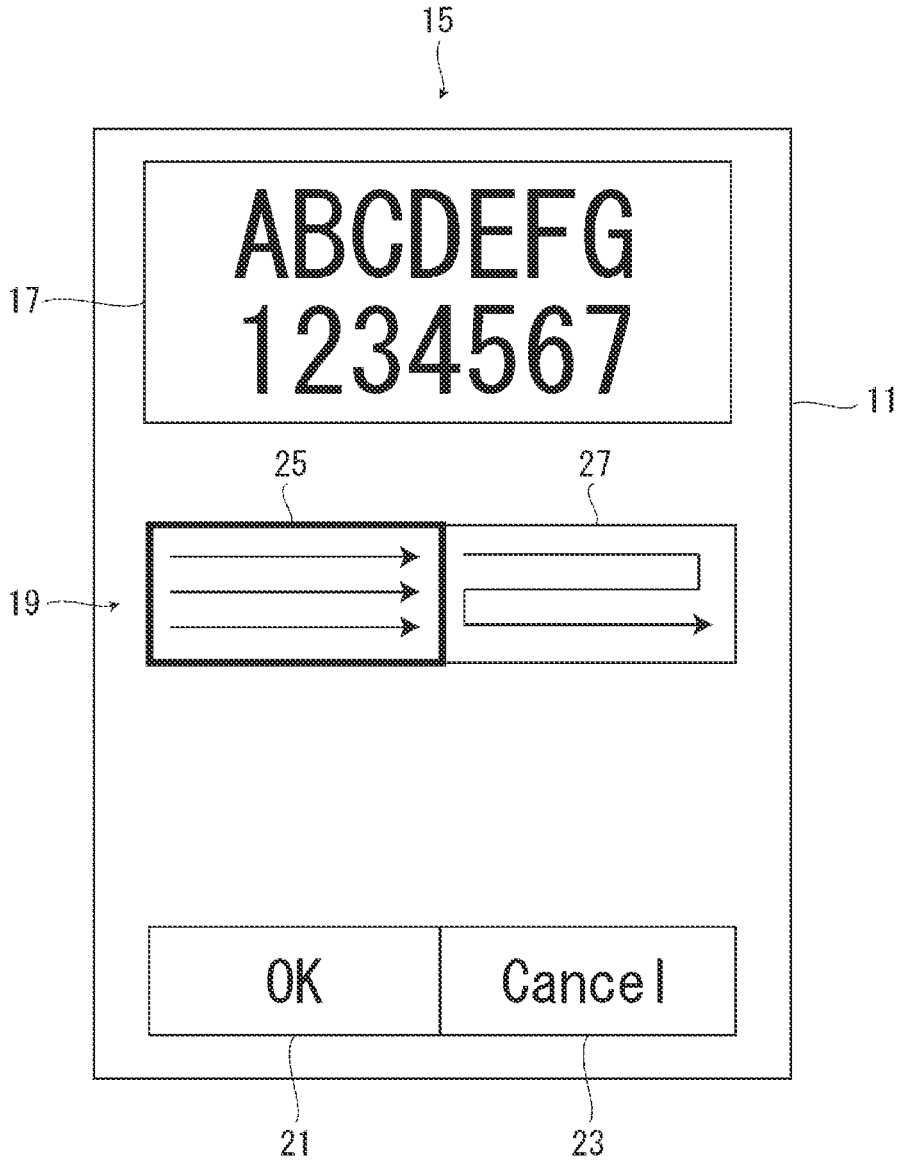
FIG. 10 is a diagram showing a print configuration screen.

Then, first, the designation direction designated by the print job will be described with reference to a print configuration screen 15 of the information processing device 1 shown in FIG. 10.

The print configuration screen 15 is provided with a print preview 17, a movement direction selection field 19, an OK button 21, and a cancel button 23.

In the print preview 17, there is displayed a preview of the print image 203 based on information input in a print instruction screen not shown.

The OK button 21 receives an operation for fixing the selection in the print configuration screen 15. The cancel button 23 receives an operation for canceling the selection in the print configuration screen 15.

Figure 11:
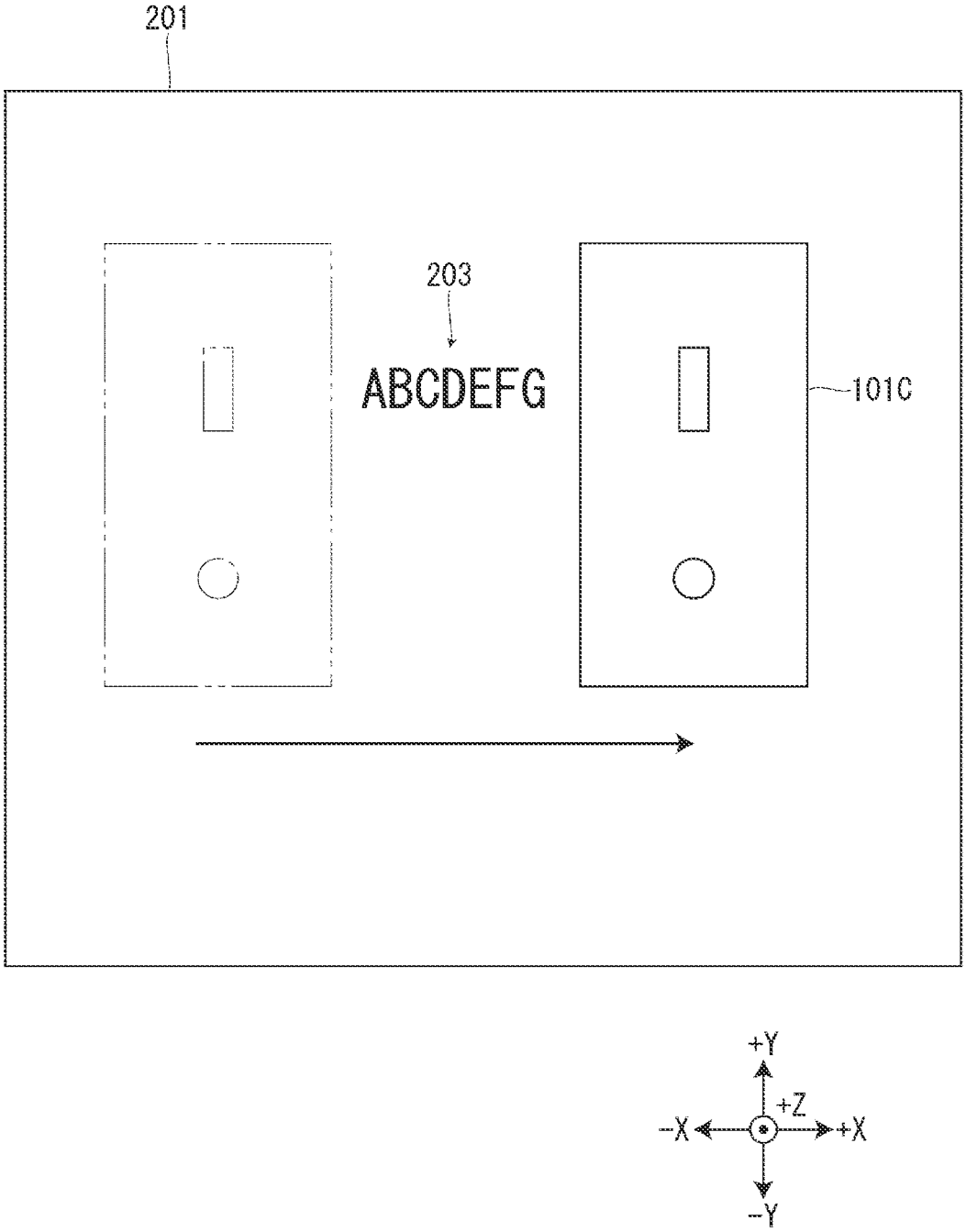
FIG. 11 is a diagram showing a state in which a first pass has been performed in unidirectional printing.
Figure 12:
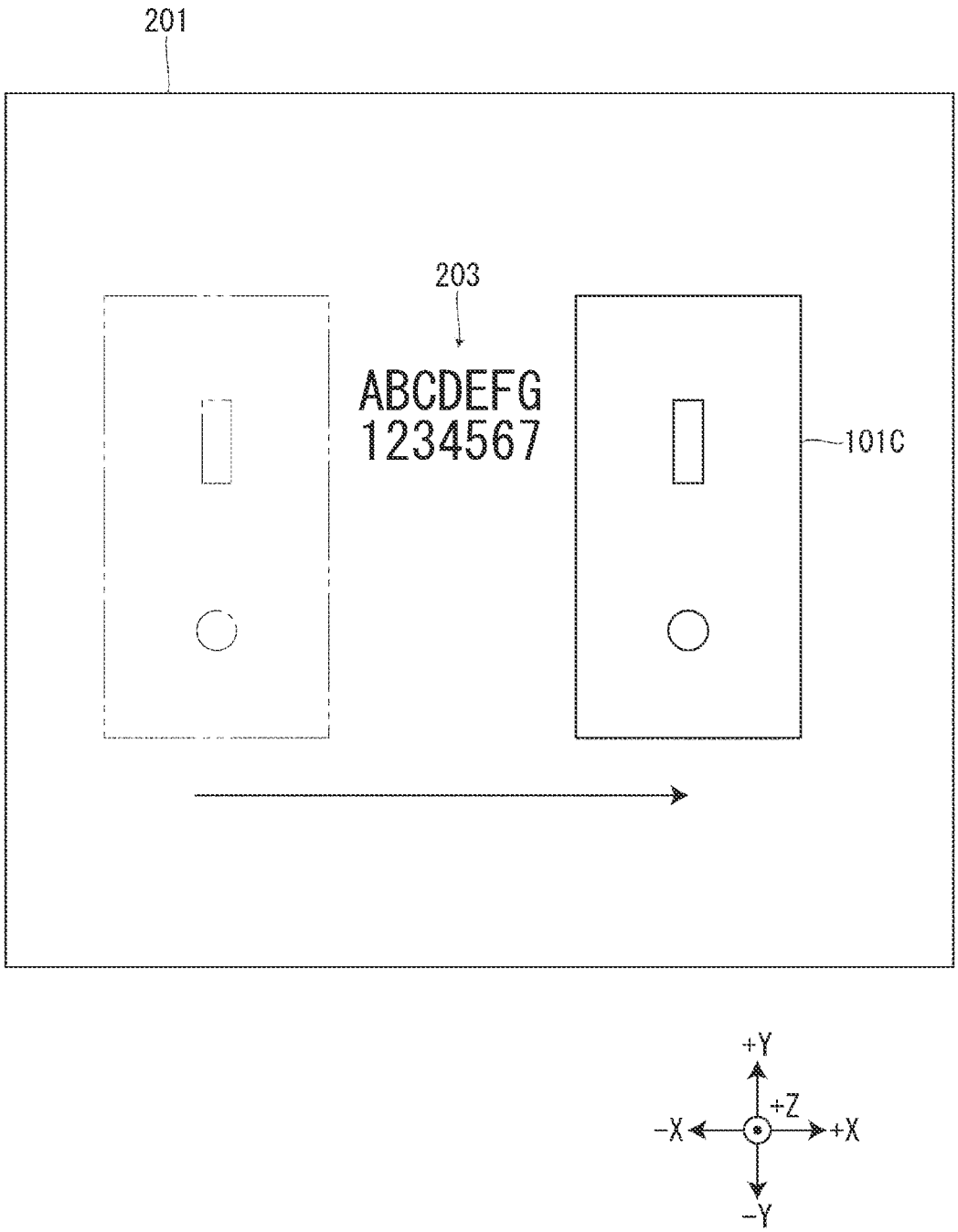
FIG. 12 is a diagram showing a state in which a second pass has been performed in the unidirectional printing.
Figure 13:
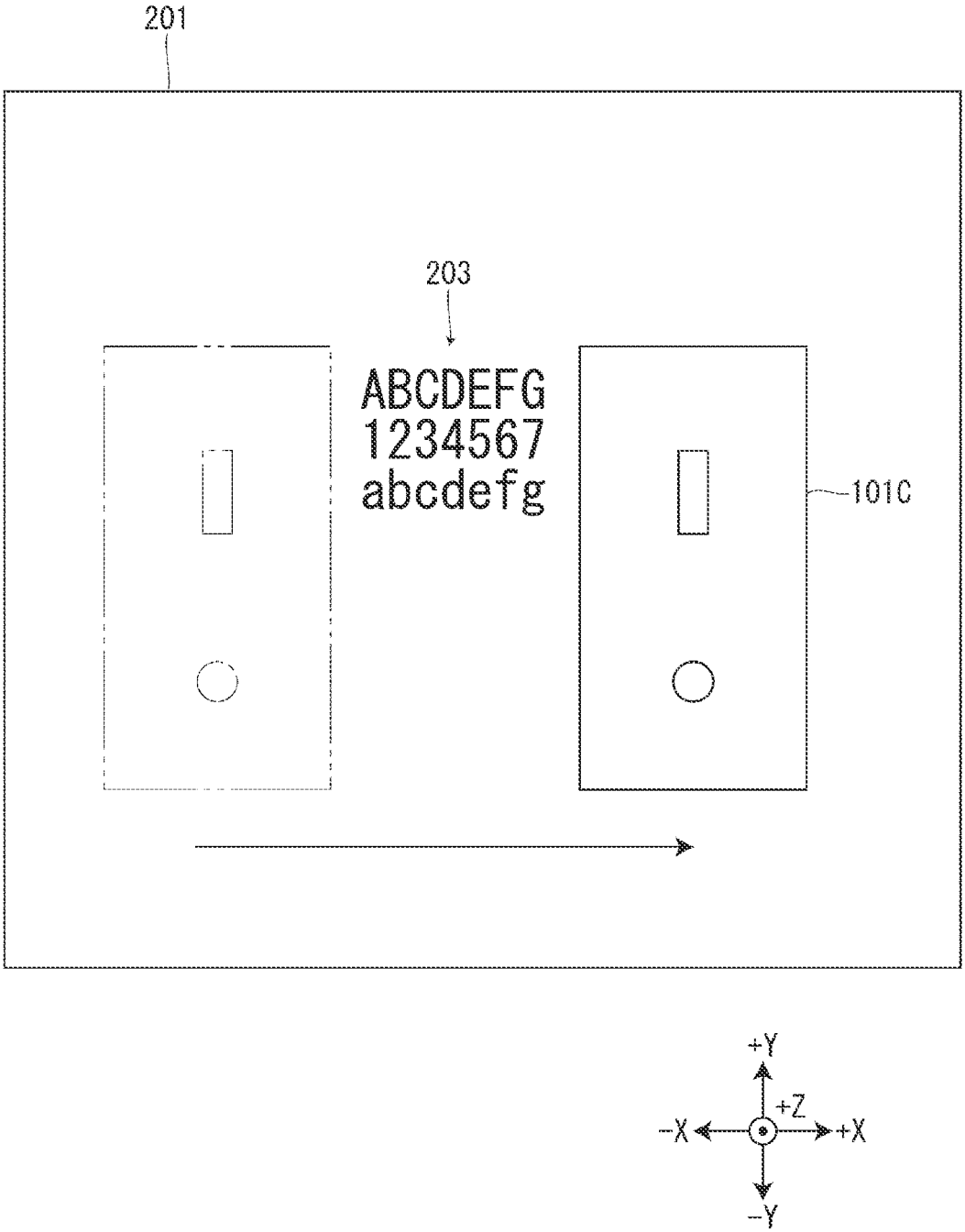
FIG. 13 is a diagram showing a state in which a third pass has been performed in the unidirectional printing.
Figure 14:
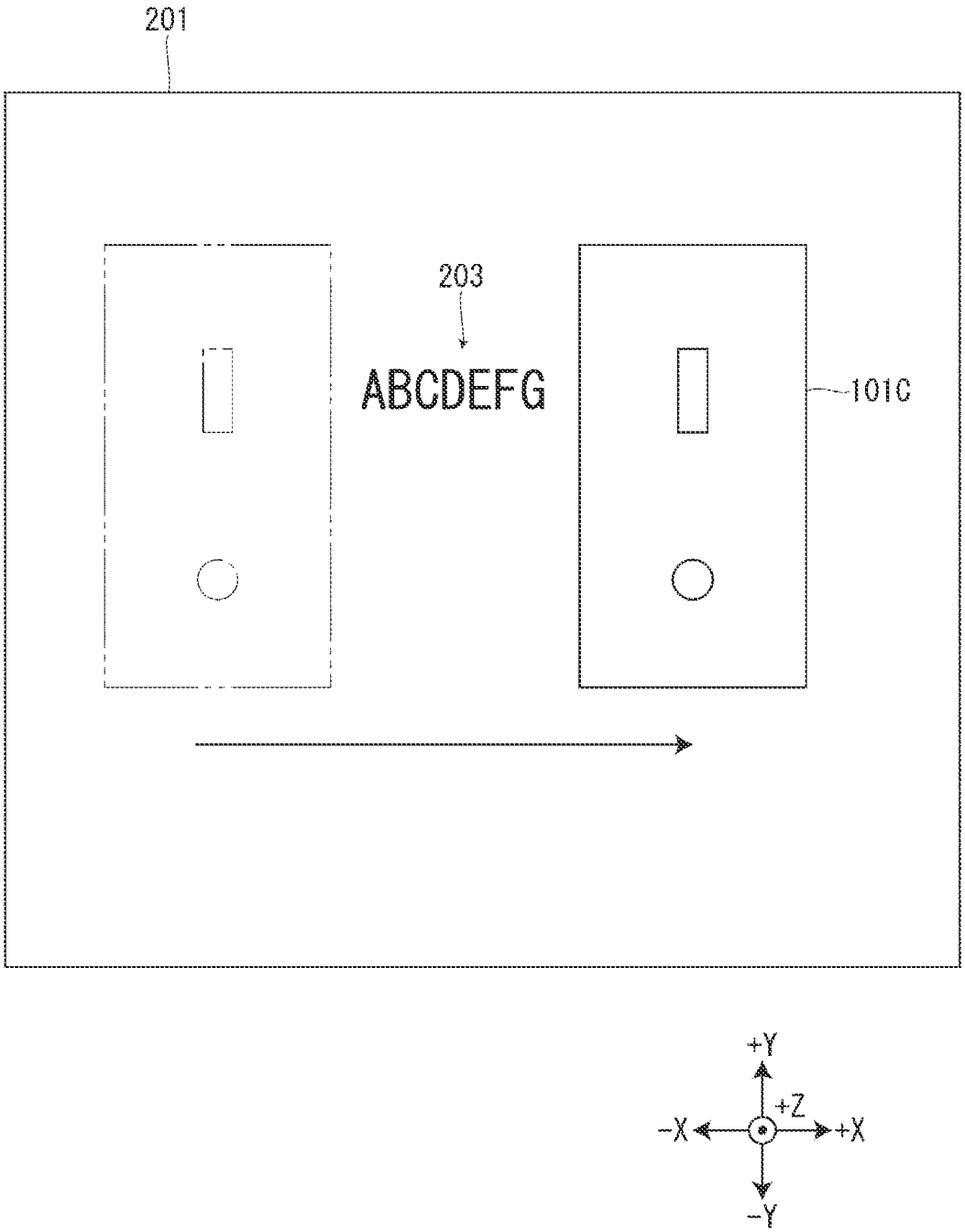
FIG. 14 is a diagram showing a state in which a first pass has been performed in bidirectional printing.
Figure 15:
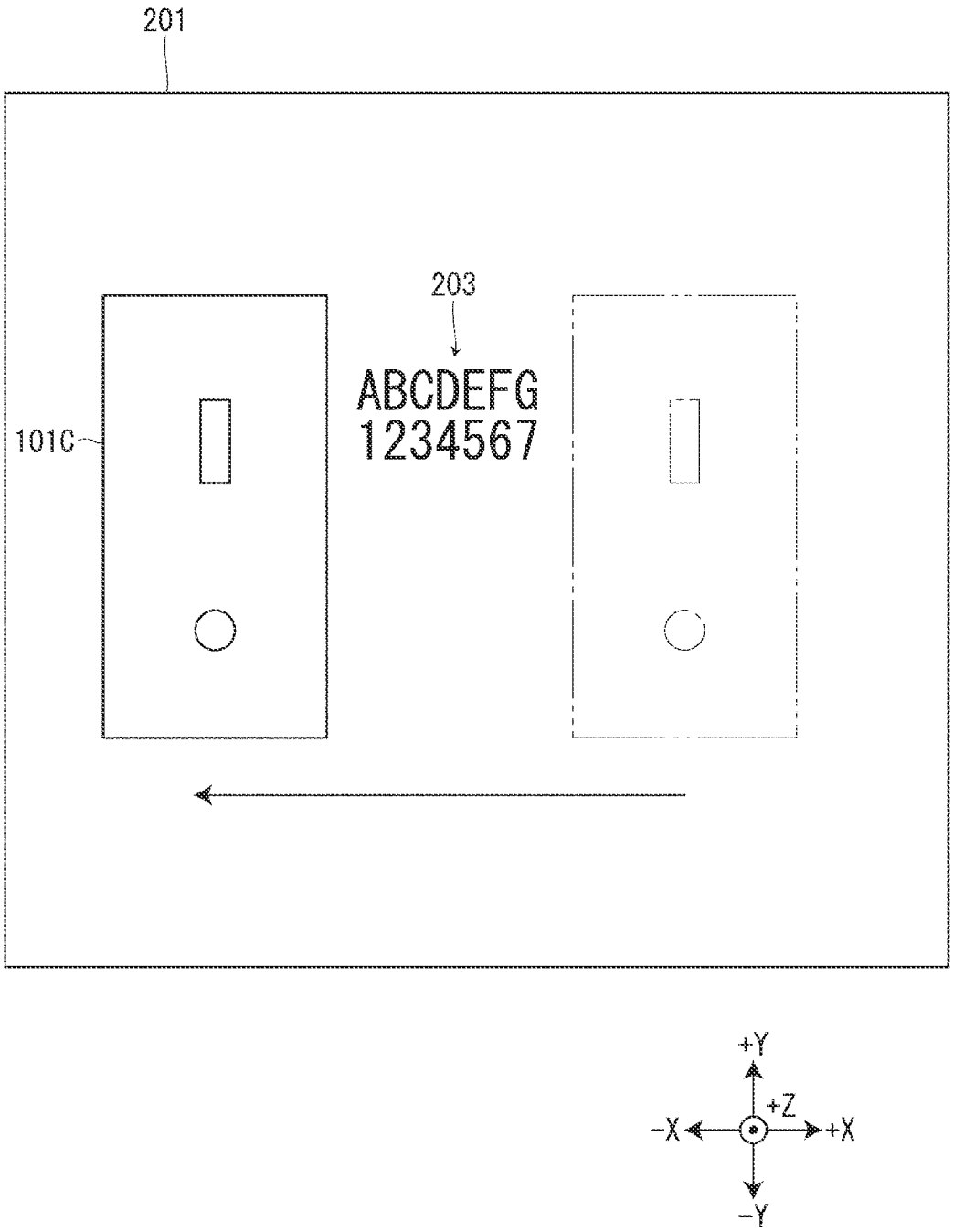
FIG. 15 is a diagram showing a state in which a second pass has been performed in the bidirectional printing.
Figure 16:
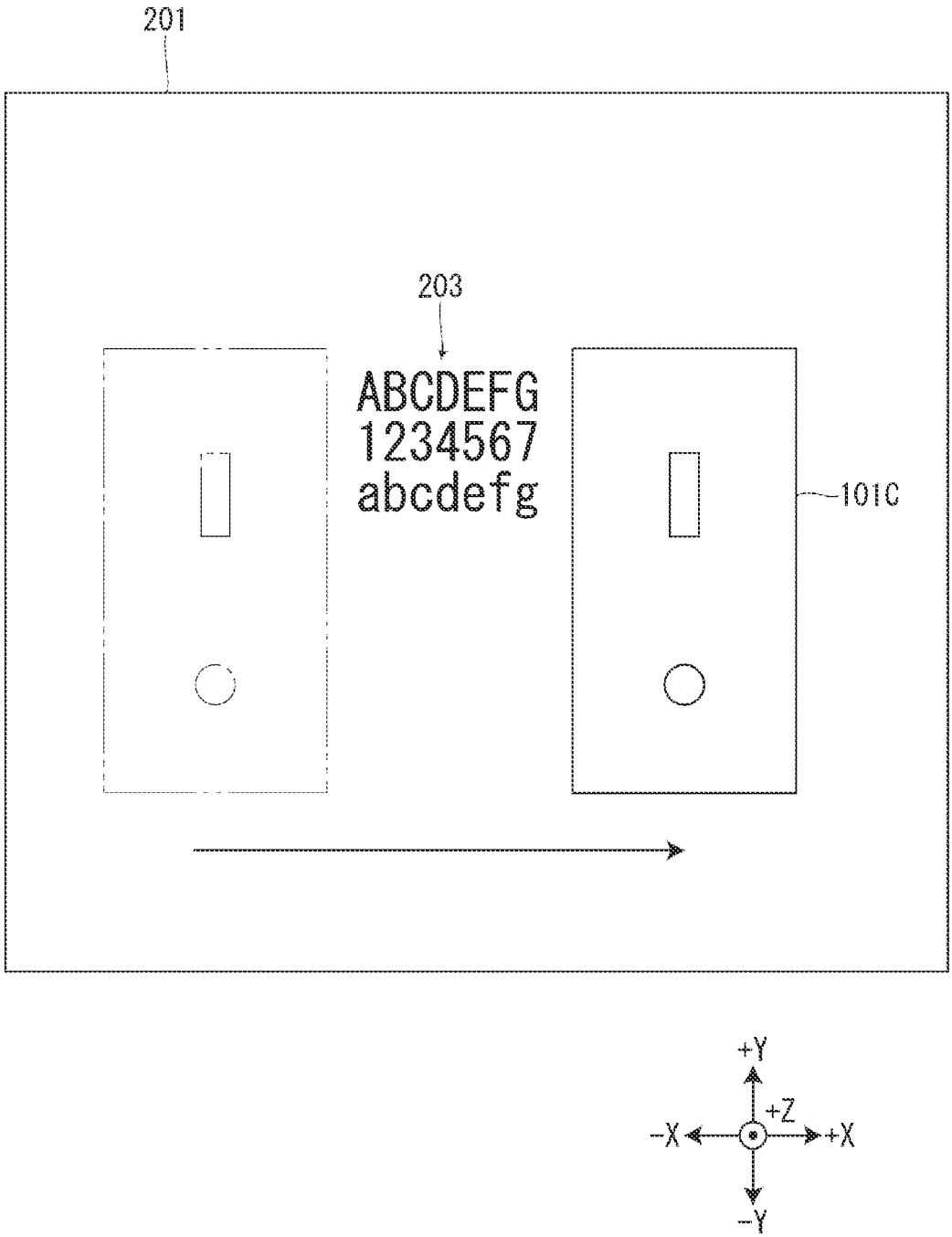
FIG. 16 is a diagram showing a state in which a third pass has been performed in the bidirectional printing.

In the movement direction selection field 19, a unidirectional printing alternative 25 for the user to select the unidirectional printing, and a bidirectional printing alternative 27 for the user to select the bidirectional printing are displayed in a selectable manner. Here, the unidirectional printing means that the printer 101C performs printing while the printer 101C is moved in the +X direction in every pass as shown in FIG. 11 through FIG. 13. The bidirectional printing means that the printer 101C performs printing while the printer 101C is moved in the +X direction in odd-numbered passes, and performs printing while the printer 101C is moved in the −X direction in even-numbered passes as shown in FIG. 14 through FIG. 16. It should be noted that the pass means a printing operation performed while the printer 101C is moved in the +X direction or the −X direction.

When the information processing device 1 receives the operation of the OK button 21, the information processing device 1 generates the print data pass by pass, and designates the movement direction of the printer 101C pass by pass. The movement direction of the printer 101C designated by the information processing device 1 pass by pass is referred to as the designation direction. The information processing device 1 transmits the print job including the print data generated and the information representing the designation direction for each pass to the printer 101C.

When the unidirectional printing alternative 25 has been selected in the movement direction selection field 19, the information processing device 1 generates the print data so that the print image 203 is appropriately printed when the printer 101C is moved in the +X direction and designates the designation direction to the +X direction in every pass.

When the bidirectional printing alternative 27 has been selected in the movement direction selection field 19, the information processing device 1 generates the print data so that the print image 203 is appropriately printed when the printer 101C is moved in the +X direction and designates the designation direction to the +X direction in the odd-numbered passes. Further, the information processing device 1 generates the print data so that the print image 203 is appropriately printed when the printer 101C is moved in the −X direction and designates the designation direction to the −X direction in the even-numbered passes.

Figure 17:
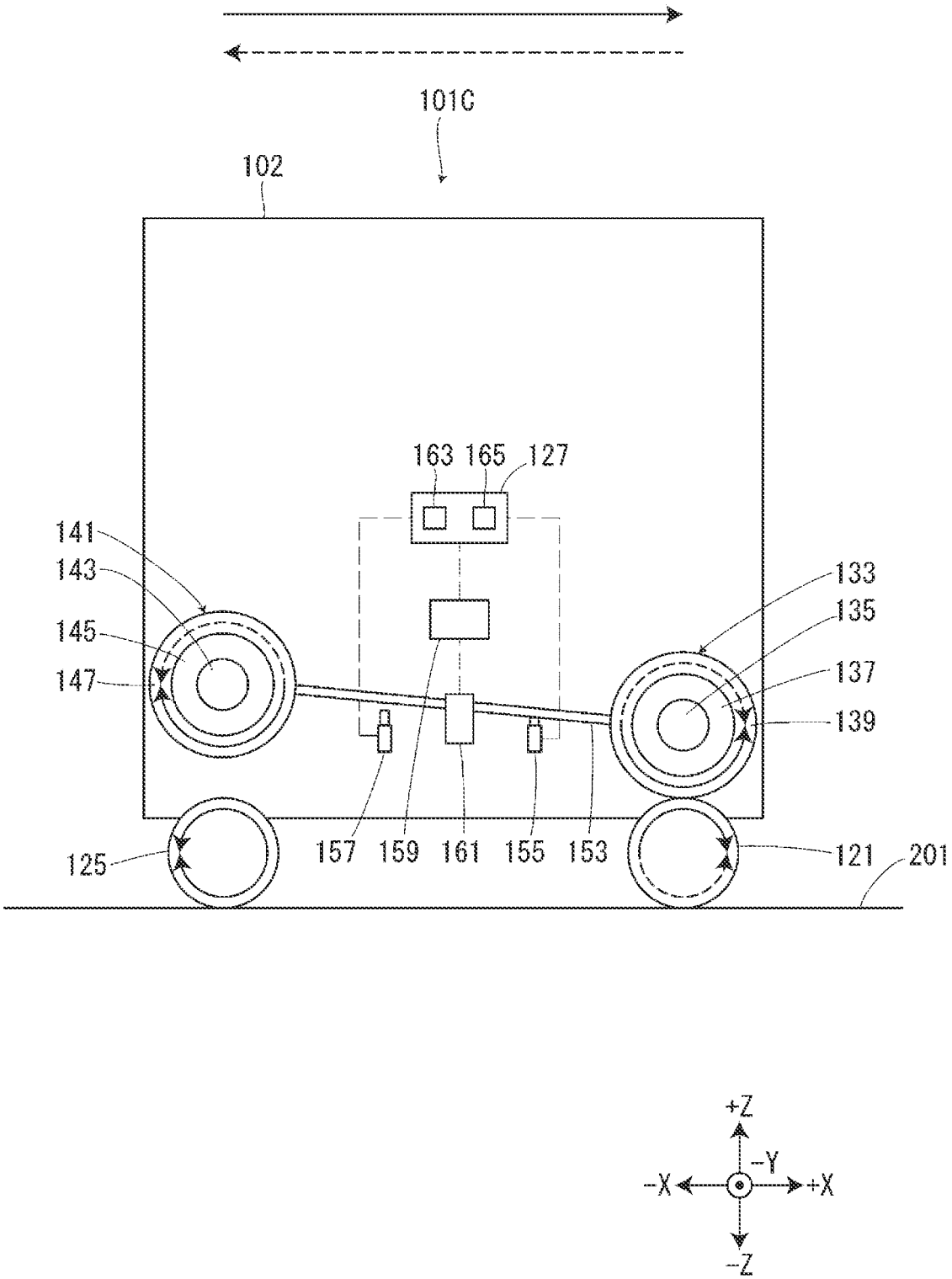
FIG. 17 is a diagram showing a first movement restriction state of a printer according to a third embodiment.
Figure 18:
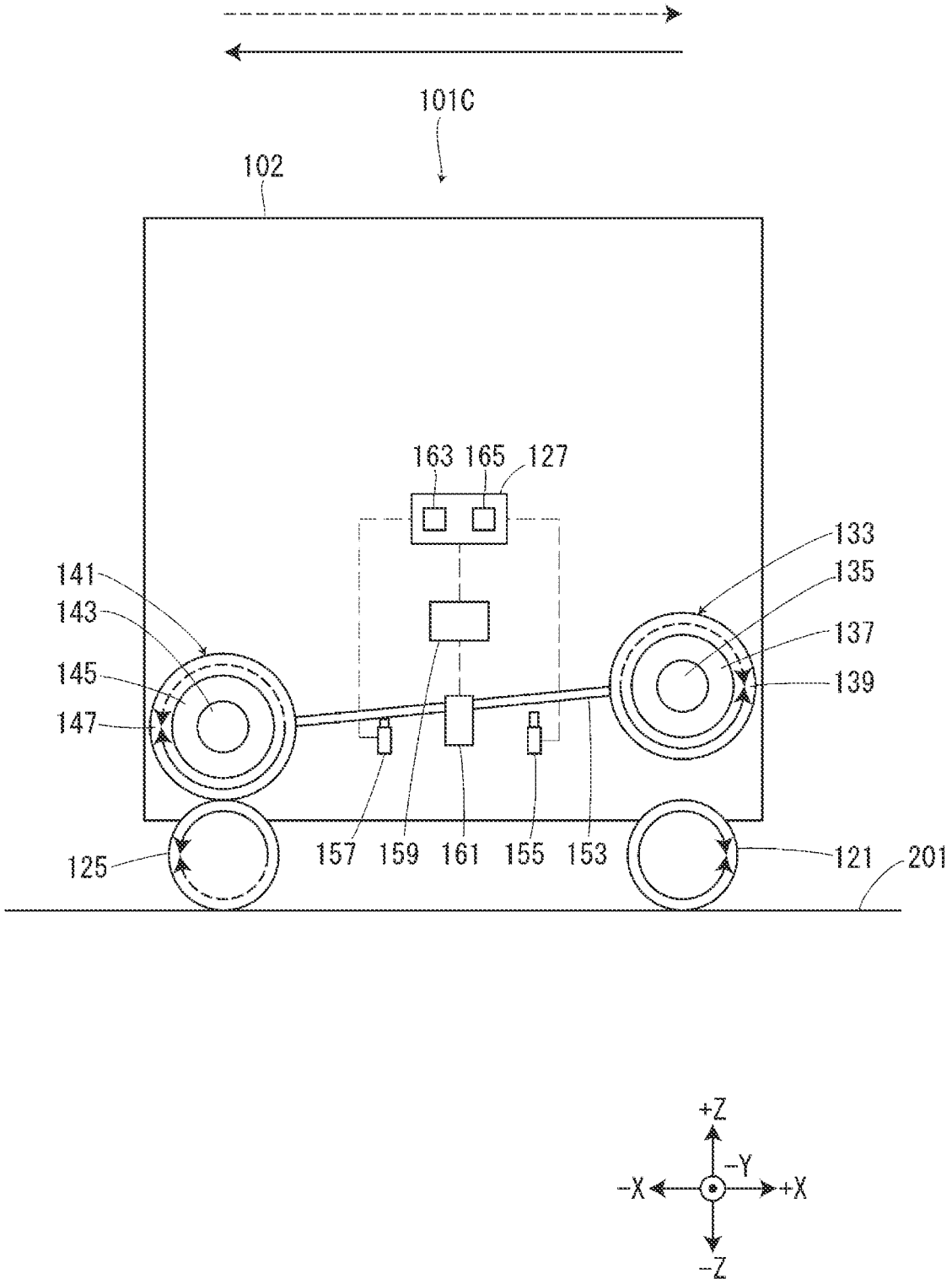
FIG. 18 is a diagram showing a second movement restriction state of the printer according to the third embodiment.

As shown in FIG. 17 and FIG. 18, the printer 101C according to the third embodiment is provided with the first one-way bearing 133 and the second one-way bearing 141 similarly to the printer 101B according to the second embodiment. On the other hand, the printer 101C according to the third embodiment is provided with a coupling member 153, a first rotation sensor 155, a second rotation sensor 157, and a drive section 159 instead of the first lever 149 and the second lever 151.

The coupling member 153 couples the first one-way bearing 133 and the second one-way bearing 141 to each other. Specifically, the coupling member 153 is formed to have a rod-like shape, the first support shaft 135 for the first one-way bearing 133 is fixed to one end portion of the coupling member 153, and the second support shaft 143 of the second one-way bearing 141 is fixed to the other end portion of the coupling member 153. Further, the coupling member 153 is rotatably supported by a coupling support part 161 disposed in substantially the middle of the coupling member 153.

The coupling member 153 can rotate to a first rotational position and a second rotational position. The first rotational position means a position of the coupling member 153 in which the first one-way bearing 133 is displaced to the first restriction position and the second one-way bearing 141 is displaced to the second allowance position as shown in FIG. 17. The second rotational position means a position of the coupling member 153 in which the first one-way bearing 133 is displaced to the first allowance position and the second one-way bearing 141 is displaced to the second restriction position as shown in FIG. 18.

The first rotation sensor 155 detects whether or not the coupling member 153 is located at the first rotational position. For example, the first rotation sensor 155 outputs ON in the state in which the coupling member 153 is located at the first rotational position, and outputs OFF in the state in which the coupling member 153 is not located at the first rotational position. It should be noted that it is possible to use, for example, a microswitch as the first rotation sensor 155.

The second rotation sensor 157 detects whether or not the coupling member 153 is located at the second rotational position. For example, the second rotation sensor 157 outputs ON in the state in which the coupling member 153 is located at the second rotational position, and outputs OFF in the state in which the coupling member 153 is not located at the second rotational position. It should be noted that it is possible to use, for example, a microswitch as the second rotation sensor 157.

The drive section 159 performs a first operation and a second operation. The first operation means an operation of displacing the first one-way bearing 133 to the first restriction position and displacing the second one-way bearing 141 to the second allowance position. The second operation means an operation of displacing the first one-way bearing 133 to the first allowance position and displacing the second one-way bearing 141 to the second restriction position. The drive section 159 rotates the coupling member 153 from the second rotational position to the first rotational position to thereby perform the first operation, and rotates the coupling member 153 from the first rotational position to the second rotational position to thereby perform the second operation. It should be noted that as the drive section 159, there can be used, for example, a motor or a solenoid.

The printing side processor 127 is provided with a job acquisition section 163 and a control section 165 as functional sections. The job acquisition section 163 and the control section 165 are realized by the printing side processor 127 executing the program stored in the printing side memory 129.

The job acquisition section 163 obtains the print job transmitted from the information processing device 1. As described above, in the print job, the designation direction as the movement direction of the printer 101C is designated pass by pass.

Based on the designation direction designated by the print job pass by pass, and the detection signals output from the first rotation sensor 155 and the second rotation sensor 157, the control section 165 determines whether or not it is necessary to make the drive section 159 perform the first operation or the second operation. Specifically, when the designation direction designated for the next pass is the +X direction, and the coupling member 153 is located at the second rotational position, the printer 101C determines that it is necessary to make the drive section 159 perform the first operation. When the designation direction designated for the next pass is the −X direction, and the coupling member 153 is located at the first rotational position, the printer 101C determines that it is necessary to make the drive section 159 perform the second operation. When the designation direction designated for the next pass is the +X direction, and the coupling member 153 is located at the first rotational position, or when the designation direction designated for the next pass is the −X direction, and the coupling member 153 is located at the second rotational position, the printer 101C determines that there is no need to make the drive section 159 perform the first operation or the second operation.

When the control section 165 determines that it is necessary to make the drive section 159 perform the first operation, the control section 165 makes the drive section 159 perform the first operation. Specifically, the control section 165 controls the drive section 159 so that the coupling member 153 rotates clockwise until ON is output from the first rotation sensor 155. Thus, the printer 101C becomes in the first movement restriction state (see FIG. 17). When the control section 165 determines that it is necessary to make the drive section 159 perform the second operation, the control section 165 makes the drive section 159 perform the second operation. Specifically, the control section 165 controls the drive section 159 so that the coupling member 153 rotates counterclockwise until ON is output from the second rotation sensor 157. Thus, the printer 101C becomes in the second movement restriction state (see FIG. 18). When the control section 165 determines that there is no need to make the drive section 159 perform the first operation or the second operation, the control section 165 makes the drive section 159 perform neither the first operation nor the second operation.

For example, when the unidirectional printing alternative 25 has been selected in the movement direction selection field 19 of the information processing device 1, the control section 165 makes the drive section 159 perform the first operation as needed in the first pass, and then does not make the drive section 159 perform neither the first operation nor the second operation in the second pass and the subsequent passes. Further, when the bidirectional printing alternative 27 has been selected in the movement direction selection field 19 of the information processing device 1, the control section 165 makes the drive section 159 alternately perform the first operation and the second operation pass by pass.

Figure 19:
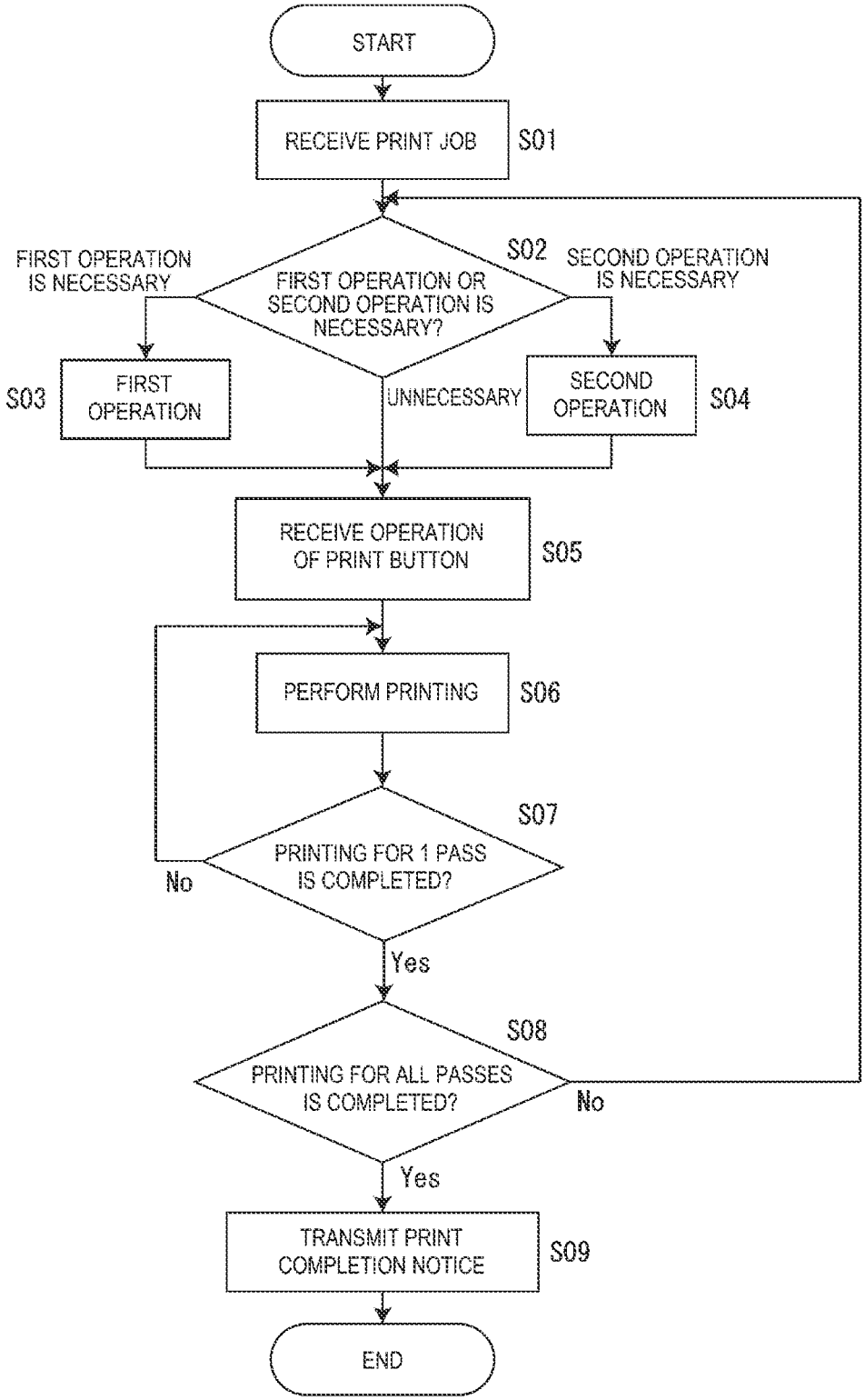
FIG. 19 is a flowchart showing a printing process executed by the printer according to the third embodiment.

The printing process to be executed by the printing side processor 127 will be described with reference to FIG. 19.

In the step S01, the job acquisition section 163 receives the print job transmitted from the information processing device 1 via the printing side communication section 131.

In the step S02, the printing side processor 127 determines whether or not it is necessary to make the drive section 159 perform the first operation or the second operation based on the designation direction designated for the next pass, and the detection signals output from the first rotation sensor 155 and the second rotation sensor 157. When the printing side processor 127 determines that it is necessary to make the drive section 159 perform the first operation, the printing side processor 127 proceeds to the step S03. When the printing side processor 127 determines that it is necessary to make the drive section 159 perform the second operation, the printing side processor 127 proceeds to the step S04. When the printing side processor 127 determines that there is no need to make the drive section 159 perform the first operation or the second operation, the printing side processor 127 proceeds to the step S05.

In the step S03, the printing side processor 127 makes the drive section 159 perform the first operation.

In the step S04, the printing side processor 127 makes the drive section 159 perform the second operation.

Figure 20:
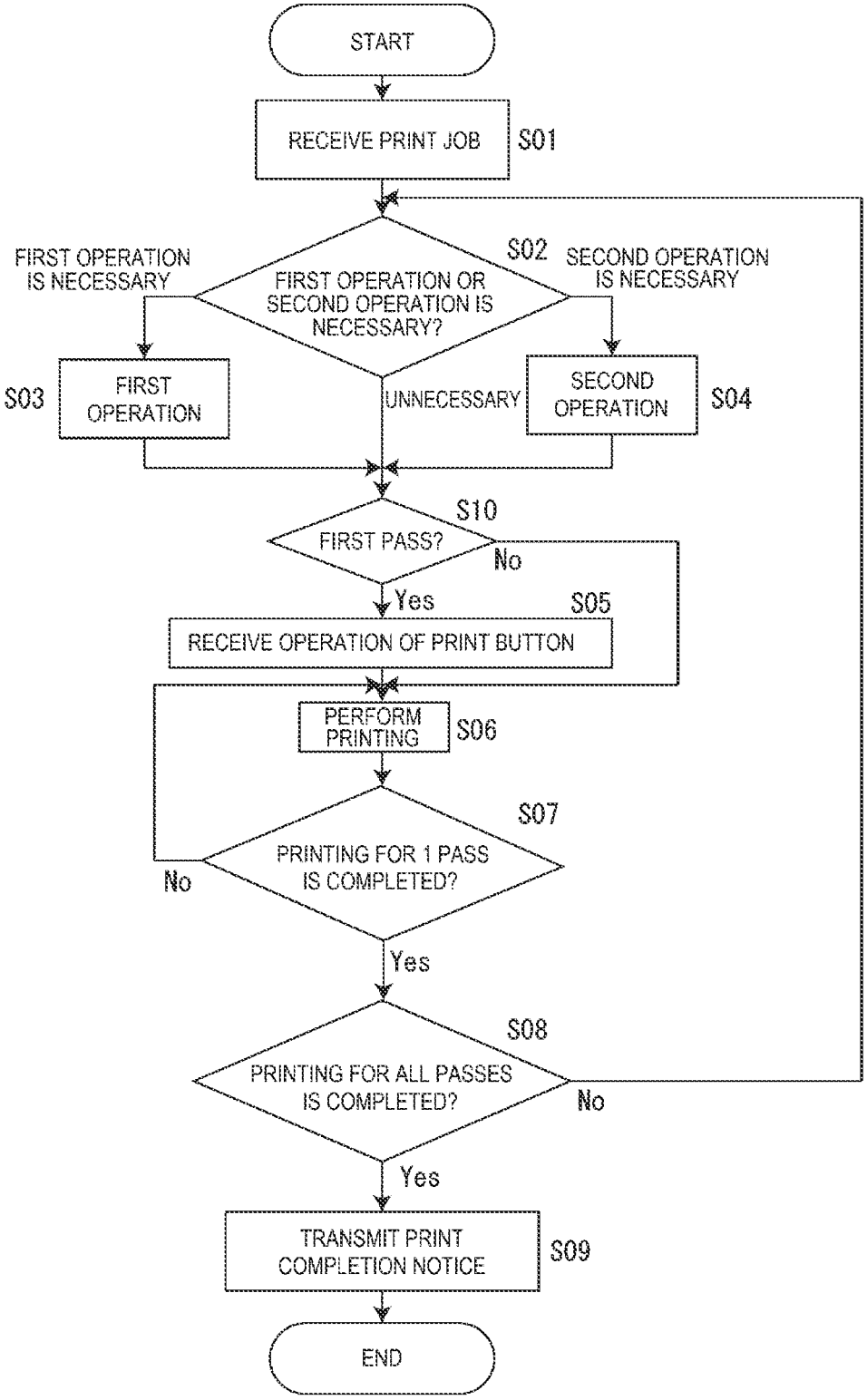
FIG. 20 is a flowchart showing a modified example of the printing process executed by the printer according to the third embodiment.

In the step S05, the printing side processor 127 receives an operation of the print button 103. It should be noted that it is possible to adopt a configuration in which the printing side processor 127 does not receive the operation of the print button 103 in the second pass and the subsequent passes as shown in FIG. 20. Specifically, the printing side processor 127 proceeds to the step S10 to determine whether to process the first pass after the step S02, and the step S03 or the step S04. When the printing side processor 127 has determined that the first pass is to be processed, the printing side processor 127 proceeds to the step S05 to receive the operation of the print button 103. In contrast, when the printing side processor 127 has determined that the pass to be processed is not the first pass, the printing side processor 127 proceeds to the step S06 without executing the step S05.

In the step S06, the printing side processor 127 makes the print head 107 perform the printing. In other words, the printing side processor 127 controls the print head 107 based on the movement direction and an amount of the movement of the printer 101C detected by the movement detection section 109 to thereby make the print head 107 perform the printing.

In the step S07, the printing side processor 127 determines whether or not the printing corresponding to 1 pass is completed. When the printing side processor 127 determines that the printing corresponding to 1 pass has been completed, the printing side processor 127 proceeds to the step S08. Further, when the printing side processor 127 determines that the printing corresponding to 1 pass is not completed, the printing side processor 127 returns to the step S06.

In the step S08, the printing side processor 127 determines whether or not the printing of all of the passes included in the print job is completed. When the printing side processor 127 determines that the printing of all of the passes included in the print job has been completed, the printing side processor 127 proceeds to the step S09. Further, when the printing side processor 127 determines that the printing of all of the passes included in the print job is not completed, the printing side processor 127 returns to the step S02.

In the step S09, the printing side processor 127 transmits a print completion notice to the information processing device 1 via the printing side communication section 131.

As described hereinabove, according to the printer 101C related to the third embodiment, when the designation direction designated pass by pass is the +X direction in the state in which the coupling member 153 rotates to the second rotational position, the printer 101C rotates the coupling member 153 to the first rotational position to thereby automatically become in the first movement restriction state. Further, when the designation direction designated pass by pass is the −X direction in the state in which the coupling member 153 rotates to the first rotational position, the printer 101C rotates the coupling member 153 to the second rotational position to thereby automatically become in the second movement restriction state. Therefore, the direction in which the movement of the printer 101C is restricted can automatically be switched in accordance with the designation direction designated pass by pass.

It should be noted that the drive section 159 is not limited to the configuration of rotating the coupling member 153 to thereby displace the first one-way bearing 133 and the second one-way bearing 141 in tandem with each other, and can be provided with a configuration of individually displacing the first one-way bearing 133 and the second one-way bearing 141.

The printer 101C can be provided with a configuration of detecting which one of the first rotational position and the second rotational position the coupling member 153 is located at using another sensor such as an encoder instead of the first rotation sensor 155 and the second rotation sensor 157. Further, it is also possible for the printer 101C to be provided with a configuration in which operation history information representing the fact that the first operation or the second operation has been performed is stored in the printing side memory 129 when the drive section 159 performs the first operation or the second operation, and then, which one of the first rotational position and the second rotational position the coupling member 153 is located at is detected by referring to the operation history information. Specifically, it is possible for the printer 101C to determine that the coupling member 153 is located at the first rotational position when the operation history information represents that first operation has been performed at the last minute, and determine that the coupling member 153 is located at the second rotational position when the operation history information represents that the second operation has been performed at the last minute.

Other Modified Examples

It is obvious that the embodiments described above are not a limitation, and that it is possible to adopt a variety of configurations within the scope or the spirit of each of the embodiments. For example, the embodiments described above can be modified into the following aspects besides the above. Further, it is also possible to adopt a configuration obtained by combining the embodiments and the modified examples with each other.

The first one-way bearing 133 is not limited to the configuration of having contact with the first roller 121 to thereby restrict the counterclockwise rotation of the first roller 121. For example, it is possible for the first one-way bearing 133 to be provided with a configuration of restricting the counterclockwise rotation of the first roller 121 via a single intermediate roller or a plurality of intermediate rollers disposed between the first one-way bearing 133 and the first roller 121. Further, it is possible for the first one-way bearing 133 to be provided with a configuration of having contact with the first roller shaft 119 to thereby restrict the counterclockwise rotation of the first roller 121. The same applies to the second one-way bearing 141.

Figure 21:
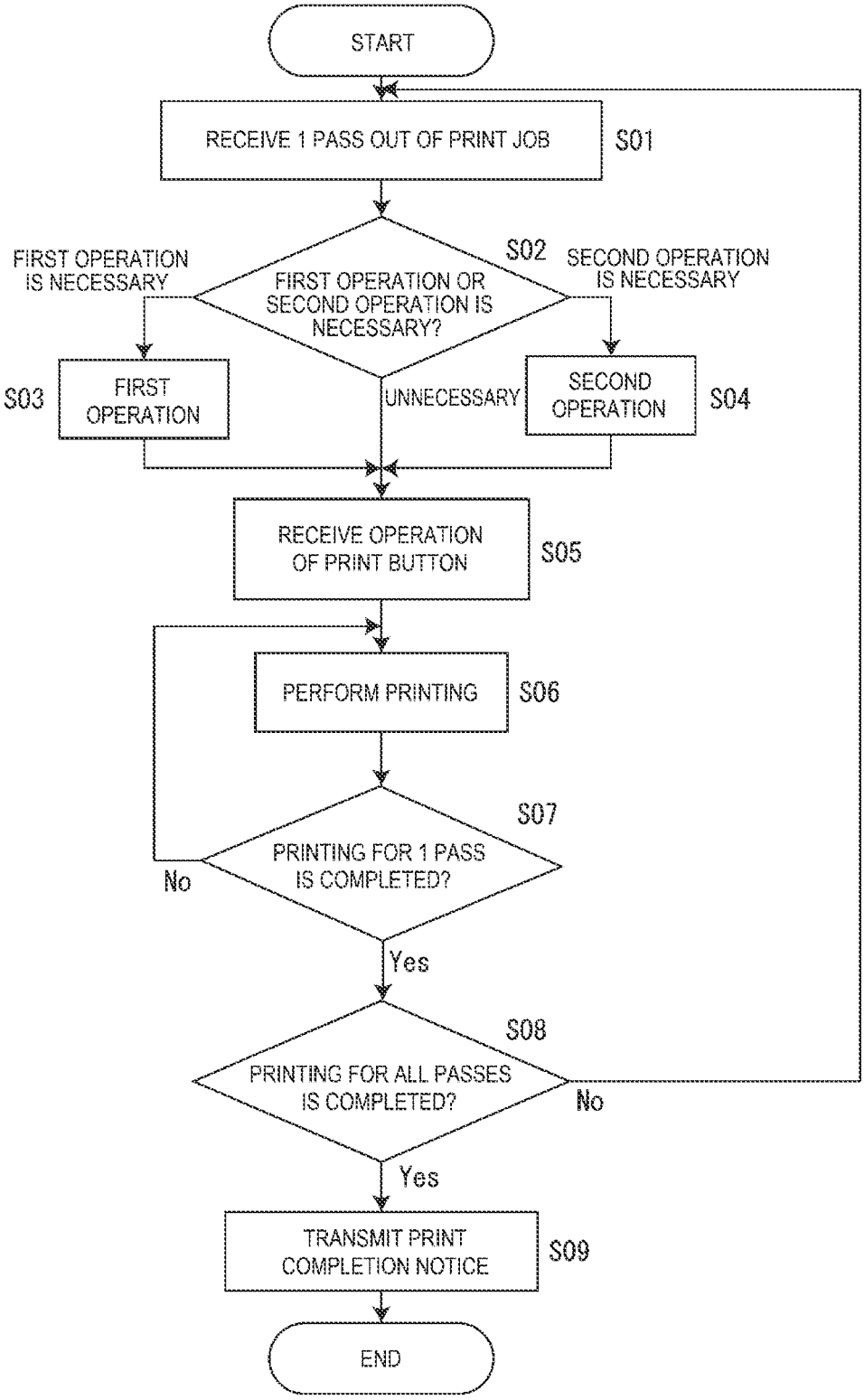
FIG. 21 is a flowchart showing another modified example of the printing process executed by the printer according to the third embodiment.

When the print image 203 is printed by a plurality of passes, the information processing device 1 is not limited to the configuration of collecting the plurality of passes to generate the single print job, and can be provided with a configuration of generating the print job for each of the passes. In this case, as shown in FIG. 21, the printing side processor 127 receives a part corresponding to 1 pass out of the print job from the information processing device 1 in the step S01. The printing side processor 127 returns to the step S01 when the single pass is completed, and then receives the print job for the next pass from the information processing device 1.

The print head 107 is not limited to the inkjet head, and can be, for example, a thermal head for performing printing using a thermal transfer system.

Additional Description

Hereinafter, the printer will additionally be described.

The printer is a printer for performing printing on a medium while being manually moved in a first direction relatively to the medium, and includes a roller having frictional contact with the medium while the printer is moved in the first direction to thereby rotate in a first rotational direction, and a first rotation restriction section which allows the roller to rotate in the first rotational direction and restricts the roller's rotating in a second rotational direction opposite to the first rotational direction.

According to this configuration, due to the first rotation restriction section, the roller is allowed to rotate in the first rotational direction, and its rotating in the second rotational direction is restricted. Thus, the printer is allowed to be moved in the first direction, and its moving in a second direction opposite to the first direction is restricted. Therefore, it is possible to prevent the user from mistakenly moving the printer in the second direction when the user should move the printer in the first direction in order for the printer to perform printing.

It should be noted that the +X direction is an example of the "first direction." The clockwise direction is an example of the "first rotational direction" when viewed from the −Y direction. The counterclockwise direction is an example of the "second rotational direction" when viewed from the −Y direction. The first one-way bearing 133 is an example of the "first rotation restriction section."

In this case, the printer may further include a second rotation restriction section which restricts the roller's rotating in the first rotational direction and allows the roller to rotate in the second rotational direction opposite to the first rotational direction, the printer may perform printing on the medium while being manually moved in a second direction relatively to the medium, the roller may have frictional contact with the medium while the printer is moved in the second direction to thereby rotate in the second rotational direction, the first rotation restriction section may be displaced to a first restriction position where the first rotation restriction section allows the roller to rotate in the first rotational direction and restricts the roller's rotating in the second rotational direction, and a first allowance position where the first rotation restriction section allows the roller to rotate in the first rotational direction and allows the roller to rotate in the second rotational direction, and the second rotation restriction section may be displaced to a second restriction position where the second rotation restriction section restricts the roller's rotating in the first rotational direction and allows the roller to rotate in the second rotational direction, and a second allowance position where the second rotation restriction section allows the roller to rotate in the first rotational direction and allows the roller to rotate in the second rotational direction.

According to this configuration, when the first rotation restriction section is displaced to the first restriction position and the second rotation restriction section is displaced to the second allowance position, the roller is allowed to rotate in the first rotational direction, and its rotating in the second rotational direction is restricted. Thus, the printer becomes in a state where being moved in the first direction is allowed, and being moved in the second direction is restricted. Therefore, it is possible to prevent the user from mistakenly moving the printer in the second direction when the user should move the printer in the first direction in order for the printer to perform printing. On the other hand, when the first rotation restriction section is displaced to the first allowance position and the second rotation restriction section is displaced to the second restriction position, the roller's rotating in the first rotational direction is restricted, and rotating in the second rotational direction is allowed. Thus, the printer becomes in a state where being moved in the first direction is restricted, and being moved in the second direction is allowed. Therefore, it is possible to prevent the user from mistakenly moving the printer in the first direction when the user should move the printer in the second direction in order for the printer to perform printing.

It should be noted that the −X direction is an example of the "second direction." The second one-way bearing 141 is an example of the "second rotation restriction section."

In this case, the roller may include a first roller and a second roller, the first rotation restriction section may allow the first roller to rotate in the first rotational direction and restrict the first roller's rotating in the second rotational direction at the first restriction position, and may allow the first roller to rotate in the first rotational direction and allow the first roller to rotate in the second rotational direction at the first allowance position, and the second rotation restriction section may restrict the second roller's rotating in the first rotational direction and allow the second roller to rotate in the second rotational direction at the second restriction position, and may allow the second roller to rotate in the first rotational direction and allow the second roller to rotate in the second rotational direction at the second allowance position.

According to this configuration, when the first rotation restriction section is displaced to the first restriction position and the second rotation restriction section is displaced to the second allowance position, the first roller is allowed to rotate in the first rotational direction, and its rotating in the second rotational direction is restricted. Thus, the printer becomes in a state where being moved in the first direction is allowed, and being moved in the second direction is restricted. On the other hand, when the first rotation restriction section is displaced to the first allowance position and the second rotation restriction section is displaced to the second restriction position, the second roller's rotating in the first rotational direction is restricted, and its rotating in the second rotational direction is allowed. Thus, the printer becomes in a state where being moved in the first direction is restricted, and being moved in the second direction is allowed.

In this case, there may further be included a drive section configured to perform a first operation of displacing the first rotation restriction section to the first restriction position and displacing the second rotation restriction section to the second allowance position, and a second operation of displacing the first rotation restriction section to the first allowance position and displacing the second rotation restriction section to the second restriction position.

According to this configuration, by the drive section performing the first operation, the printer becomes in the state where being moved in the first direction is allowed, and being moved in the second direction is restricted. On the other hand, by the drive section performing the second operation, the printer becomes in the state of being restricted from being moved in the first direction, and allowed to be moved in the second direction. Therefore, it is possible to easily switch between the directions in which the movement of the printer is restricted.

In this case, there may further be included a coupling member configured to couple the first rotation restriction section and the second rotation restriction section to each other, and the drive section may drive the coupling member to perform the first operation and the second operation.

According to this configuration, the displacement of the first rotation restriction section to the first restriction position and the displacement of the second rotation restriction section to the second allowance position can be performed in tandem with each other in the first operation. Further, the displacement of the first rotation restriction section to the first allowance position and the displacement of the second rotation restriction section to the second restriction position can be performed in tandem with each other in the second operation.

In this case, there may further be included a job acquisition section configured to obtain a print job in which a movement direction of the printer is designated pass by pass, and a control section configured to control the drive section, the control section may make the drive section perform the first operation when a designation direction as a movement direction of the printer designated in the print job is the first direction in a state in which the first rotation restriction section is displaced to the first allowance position and the second rotation restriction section is displaced to the second restriction position, and the control section may make the drive section perform the second operation when the designation direction is the second direction in a state in which the first rotation restriction section is displaced to the first restriction position and the second rotation restriction section is displaced to the second allowance position.

According to this configuration, the drive section performs the first operation when the designation direction as the movement direction of the printer designated in the print job is the first direction in the state in which the first rotation restriction section is displaced to the first allowance position and the second rotation restriction section is displaced to the second restriction position. Thus, the printer automatically becomes in the state where being moved in the first direction is allowed, and being moved in the second direction is restricted. Further, the drive section performs the second operation when the designation direction is the second direction in the state in which the first rotation restriction section is displaced to the first restriction position and the second rotation restriction section is displaced to the second allowance position. Thus, the printer automatically becomes in the state where being moved in the first direction is restricted, and being moved in the second direction is allowed. Therefore, the direction in which the movement of the printer is restricted can automatically be switched in accordance with the designation direction designated pass by pass.

In this case, the job acquisition section may obtain the print job pass by pass after completing printing for one pass.

According to this configuration, when the print job is transmitted pass by pass, it is possible to obtain the print job pass by pass.

In this case, the job acquisition section may obtain all of the passes included in the print job in a single reception operation before printing.

According to this configuration, it is possible to receive all of the passes included in the print job in a lump before printing.

What is claimed is:

1. A printer configured to perform printing on a medium while being manually moved in a first direction relatively to the medium, comprising:

a roller configured to have direct frictional contact with the medium while the printer is moved in the first direction to thereby rotate in a first rotational direction;

a first rotation restriction section configured to allow the roller to rotate in the first rotational direction and restrict the roller from rotating in a second rotational direction opposite to the first rotational direction; and a second rotation restriction section configured to restrict the from rotating in the first rotational direction and allow the roller to rotate in the second rotational direction opposite to the first rotational direction, wherein the printer is configured to perform printing on the medium while being manually moved in a second direction different from the first direction relatively to the medium, the roller is configured to have frictional contact with the medium while the printer is moved in the second direction to there rotate in the second rotational direction, the first rotation restriction section is configured to be selectively displace to a first restriction position where the first rotation restriction section allows the roller to rotate in the first rotational direction and restricts the from rotating in the second rotational direction, and a first allowance position where the first rotation restriction section allows the roller to rotate in the first rotational direction and allows the roller to rotate in the second rotational direction, and the second rotation restriction section is configured to be selectively displaced to a second restriction position where second rotation restriction section restricts the roller from rotating in the first rotational direction and allows the roller to rotate in the second rotational direction, and a second allowance position where the second rotation restriction section allows the roller to rotate in the first rotational direction and allows the roller to rotate in the second rotational direction.

2. The printer according to claim 1, wherein the roller includes a first roller and a second roller, the first rotation restriction section is configured to allow the first roller to rotate in the first rotational direction and restrict the first roller from rotating in the second rotational direction at the first restriction position, and allow the first roller to rotate in the first rotational direction and allow the first roller to rotate in the second rotational direction at the first allowance position, and the second rotation restriction section is configured to restrict the second roller from rotating in the first rotational direction and allow the second roller to rotate in the second rotational direction at the second restriction position, and allow the second roller to rotate in the first rotational direction and allow the second roller to rotate in the second rotational direction at the second allowance position.

3. The printer according to claim 1, further comprising:

a drive section configured to perform a first operation of displacing the first rotation restriction section to the first restriction position and displacing the second rotation restriction section to the second allowance position, and a second operation of displacing the first rotation restriction section to the first allowance position and displacing the second rotation restriction section to the second restriction position.

4. The printer according to claim 3, further comprising:

a coupling member configured to couple the first rotation restriction section and the second rotation restriction section to each other, wherein the drive section is configured to drive the coupling member to perform the first operation and the second operation.

5. The printer according to claim 3, further comprising:

a job acquisition section configured to obtain a print job in which a movement direction of the printer is designated pass by pass; and a control section configured to control the drive section, wherein the control section is configured to make the drive section perform the first operation when a designation direction as a movement direction of the printer designated in the print job is the first direction in a state in which the first rotation restriction section is displaced to the first allowance position and the second rotation restriction section is displaced to the second restriction position, and the drive section perform the second operation when the designation direction is the second direction in a state in which the first rotation restriction section is displaced to the first restriction position and the second rotation restriction section is displaced to the second allowance position.

6. The printer according to claim 5, wherein the job acquisition section is configured to obtain the print job pass by pass after completing printing for one pass.

7. The printer according to claim 5, wherein the job acquisition section is configured to obtain all of the passes included in the print job in a single reception operation before printing.

* * * * *